United States Patent [19]

Yamada et al.

[11] 4,354,067

[45] Oct. 12, 1982

[54] AUDIO-BAND ELECTROMECHANICAL VIBRATION CONVERTER

[75] Inventors: Kyota Yamada; Akira Komatsu, both of Tokyo, Japan

[73] Assignee: Bodysonic Kabushiki Kaisha, Tokyo, Japan

[21] Appl. No.: 25,501

[22] Filed: Mar. 30, 1979

[30] Foreign Application Priority Data

| | | | |
|---|---|---|---|
| May 17, 1978 | [JP] | Japan | 53-58518 |
| May 31, 1978 | [JP] | Japan | 53-65486 |
| May 31, 1978 | [JP] | Japan | 53-65487 |
| May 31, 1978 | [JP] | Japan | 53-65488 |
| Jun. 22, 1978 | [JP] | Japan | 53-75580 |
| Jul. 27, 1978 | [JP] | Japan | 53-103285[U] |
| Jul. 27, 1978 | [JP] | Japan | 53-103286[U] |
| Aug. 7, 1978 | [JP] | Japan | 53-96014 |
| Oct. 5, 1978 | [JP] | Japan | 53-137134[U] |
| Nov. 20, 1978 | [JP] | Japan | 53-159887[U] |
| Dec. 26, 1978 | [JP] | Japan | 53-181743[U] |

[51] Int. Cl.[3] ..... H04R 1/00; H04R 9/00

[52] U.S. Cl. ..... 179/146 H; 179/1 G; 179/1 R; 179/107 BC; 179/115.5 R; 179/115.5 PS; 179/121 T; 179/146 E; 179/181 W; 128/33

[58] Field of Search ..... 179/1 G, 1 GA, 107 BC, 179/115.5 R, 121 T, 146 R, 146 E, 146 H, 181 W; 128/33; 369/132, 147, 148, 149; 367/140, 178, 182, 183, 184, 185, 186, 187, 188, 189; 73/576, 578, 584, 628, 629, 632, 652, 668; 310/15, 25, 27; 335/220, 223; 116/137 R, DIG. 18; 366/108, 117, 127

[56] References Cited

U.S. PATENT DOCUMENTS

| | | | |
|---|---|---|---|
| 3,320,738 | 5/1967 | Sparing et al. | 310/15 |
| 3,728,497 | 4/1973 | Komatsu | 179/181 W |

FOREIGN PATENT DOCUMENTS

| | | |
|---|---|---|
| 2132018 | 1/1972 | Fed. Rep. of Germany . |
| 293337 | 6/1928 | United Kingdom . |
| 562071 | 6/1944 | United Kingdom . |
| 613198 | 11/1948 | United Kingdom . |
| 620301 | 3/1949 | United Kingdom . |
| 791928 | 3/1958 | United Kingdom . |
| 884338 | 12/1961 | United Kingdom . |
| 900901 | 7/1962 | United Kingdom . |
| 924499 | 4/1963 | United Kingdom . |
| 1050387 | 12/1966 | United Kingdom . |
| 1123524 | 8/1968 | United Kingdom . |
| 1258385 | 12/1971 | United Kingdom . |
| 1426089 | 2/1976 | United Kingdom . |
| 1447588 | 8/1976 | United Kingdom . |
| 1456673 | 11/1976 | United Kingdom . |
| 1508348 | 4/1978 | United Kingdom . |
| 1510154 | 5/1978 | United Kingdom . |
| 1512783 | 6/1978 | United Kingdom . |
| 1516256 | 6/1978 | United Kingdom . |

*Primary Examiner*—George G. Stellar
*Attorney, Agent, or Firm*—James C. Wray

[57] ABSTRACT

Audio-band electromechanical vibration converter characterized in that a yoke having a magnetic pole and a magnetic gap formed therein is displaceably housed by a damper in a casing to which a vibration plate is attached; a coil attached to the casing is placed in said magnetic gap; and the casing gives an output of a mechanical vibration synchronized with a low-band audio-signal.

24 Claims, 55 Drawing Figures

37b
37c
82
37a
37d
37
III
37e
IV
86'

37
37b
37d
37e
37e
37e
II
II
86
82(V)
82(V)
37
82
37c 37
37a
37b
37c
37d
37e
80b
82
III
IV

AUDIO-BAND ELECTROMECHANICAL VIBRATION CONVERTER

BACKGROUND OF THE INVENTION

The present invention relates to an audio-band electromechanical vibration converter in which a low-band electric signal causes a body-felt vibration and thereby makes it possible to appreciate double bass sound through ear drum vibration and body-felt vibration.

The lower the frequency of sound is below 150 Hz, the greater will be the proportion of sound which is felt not only as a vibration of ear drum but also as a sound pressure, i.e., air vibration felt by the body. The so-called double bass sound is felt as an air vibration which must be appreciated not only through the ear but also through the skin or body; a true appreciation of double bass sound is possible only when audio sensation is coupled with body sensation.

For ideal appreciation of double bass sound, an attempt has been made at causing a body-felt vibration synchronized with an electric signal to drive the speaker.

For instance, U.S. Pat. No. 3,366,749 discloses an audio-band electromechanical vibration converter to cause a body-felt vibration, in which a gap is formed by a yoke with a magnetic pole; a frame-wound coil is set in said gap; and a vibration is caused through magnetic interference between the magnetic force developed in said coil by an electric signal and the magnetic force of said magnetic pole. In this case a screw stem is erected on the coil frame and the coil frame is supported through a damper on the yoke in such a manner that said coil frame and said yoke can be displaced relative to each other. Thereby, since the coil frame is supported at a position deviated from the gap in which the coil is set, the coil set in the gap after fitted to the vibration plate by said screw stem is liable to be shifted in position under the load of said yoke, resulting in a failure to cause an effective vibration. It is conceivable to make the damper rigid enough to stand the load of the yoke so that the coil may be properly positioned in the gap, at whatever angle the casing is attached; in that case, however, it would be impossible to cause a satisfactory vibration of double bass. On the contrary, if the damper were made soft enough to cause a satisfactory vibration of double bass, the coil would not be properly positioned in the gap on account of the load of the yoke, thereby making the action unstable.

Moreover, since the coil frame is attached to the vibration plate by means of said screw stem erected thereon, with the thickness increased, the whole assembly becomes inevitably bulky.

In the case of a converter being attached to a vibration plate embedded in a chair from the backside of said chair, as disclosed in U.S. Pat. No. 3,366,749, said converter may be employed without any trouble, but in this case it will be necessary to modify the whole structure of the chair. If an assembly of such a converter attached to an independent vibration plate without modification of chair structure is applied to a chair, the thickness will be increased and the user of the chair will feel discomfort.

The present invention, free from the above-mentioned troubles, is characterized in that a yoke having a magnetic pole and a magnetic gap is displaceably set through a damper in a casing and said casing can produce a mechanical vibration synchronized with a low-band audio signal, without increasing the thickness of the whole assembly.

SUMMARY OF THE INVENTION

The first object of the present invention is to provide a device in which a yoke having a magnetic pole and a magnetic gap is displaceably set through a damper in a casing; said casing produces a mechanical vibration; and said casing serves as a fitting member for the vibration plate, thereby the thickness of the whole assembly not being increased.

The second object of the present invention is to provide a device in which the yoke is supported such that the coil position in the magnetic gap may not change.

The third object of the present invention is to provide a device which can be embedded in the vibration plate.

The fourth object of the present invention is to provide a device which can produce a mechanical vibration synchronized with a low-band audio signal in an audio-band electromechanical vibration converter.

The fifth object of the present invention is to provide a device which can transmit a body-felt vibration to a commercially available chair and the like without spoiling the sitting comfort.

Several other objects of the present invention will become apparent from a detailed account of its embodiments with reference to the attached drawings, in which.

Figure 2:
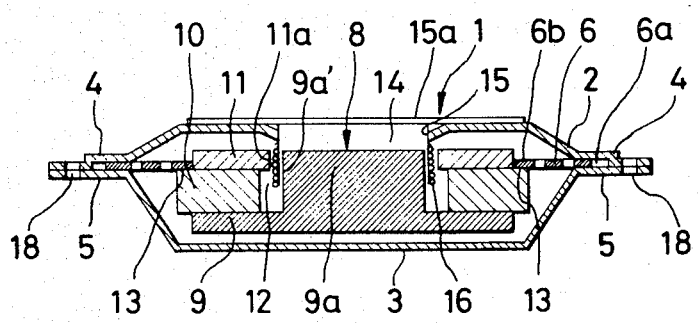
FIG. 2 is a II—II section view of FIG. 1.

FIGS. 3~6 are similar views to FIG. 2 of other embodiments of the present invention.

Figure 7:
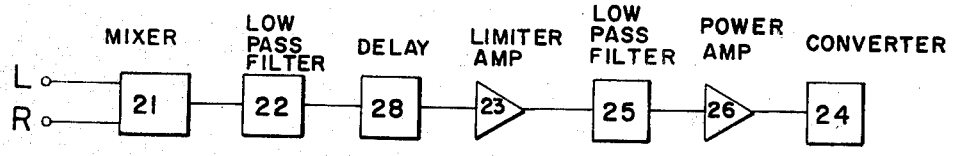
Figure 9:
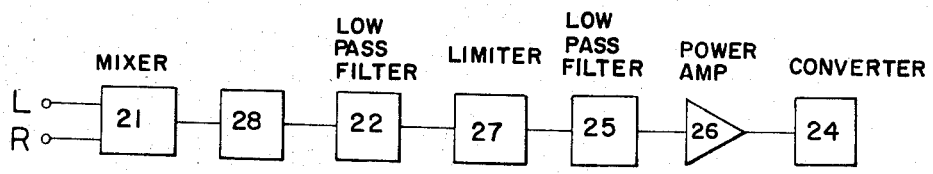

FIGS. 7 and 9 are block diagrams showing a device to drive the electromechanical vibration converter according to the present invention.

Figure 8:
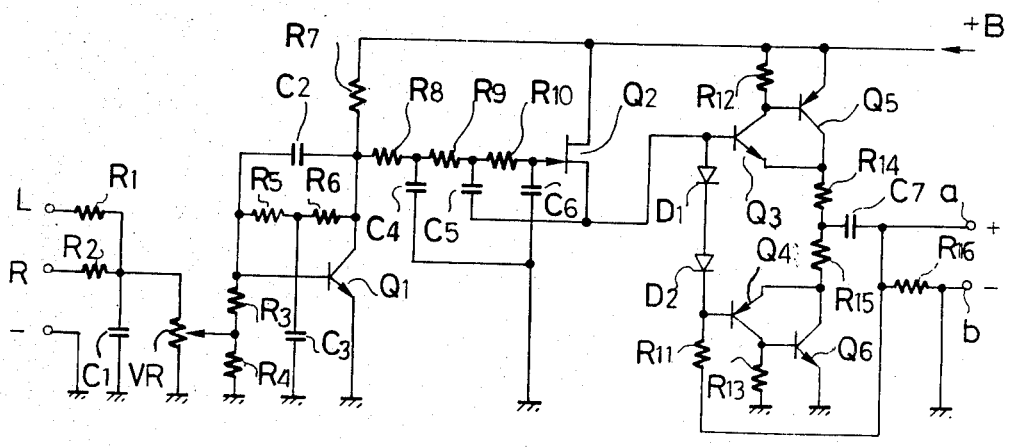

FIG. 8 shows an electric circuit embodying the block diagram of FIG. 7.

Figure 10:
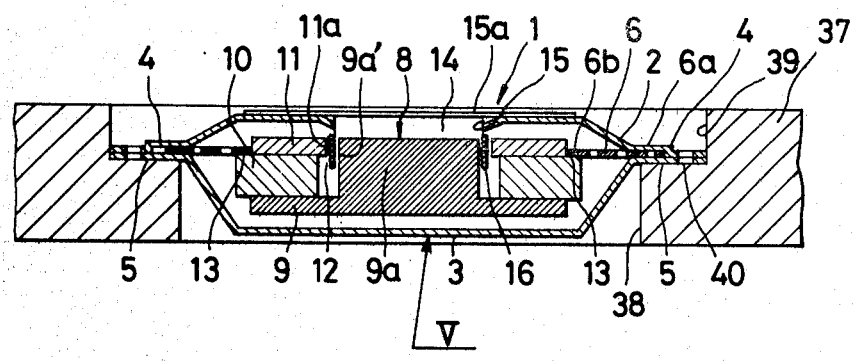

FIG. 10 is a section view illustrating the relation between the vibration plate and the electromechanical vibration converter in the present invention.

Figure 11:
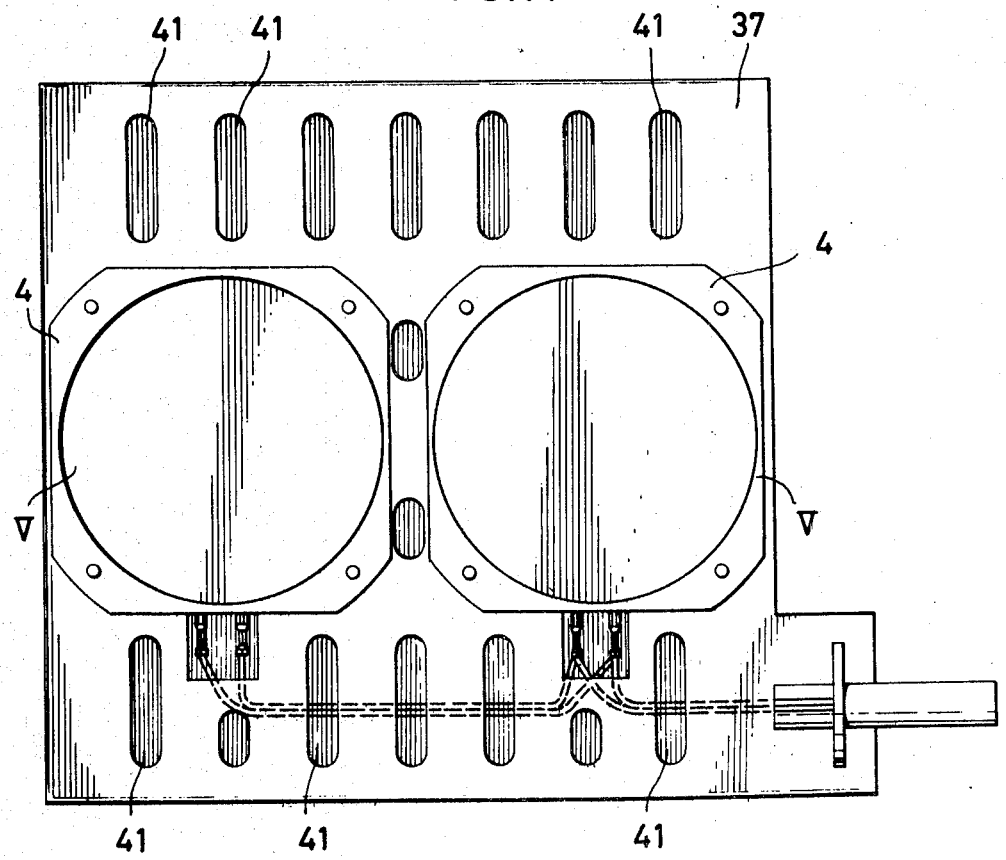

FIG. 11 is a plan view of FIG. 10.

Figure 12:
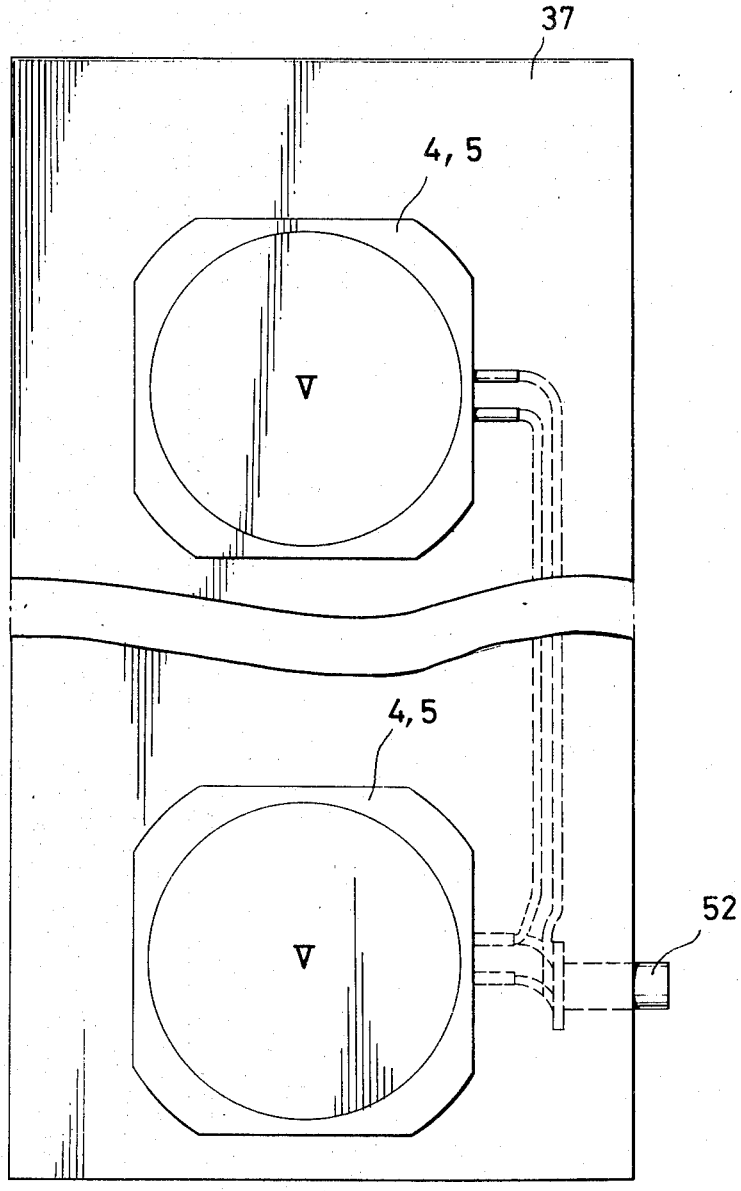

FIG. 12 is a plan view of the audio vibration element of the present invention, as removed of the elastic means.

Figure 13:
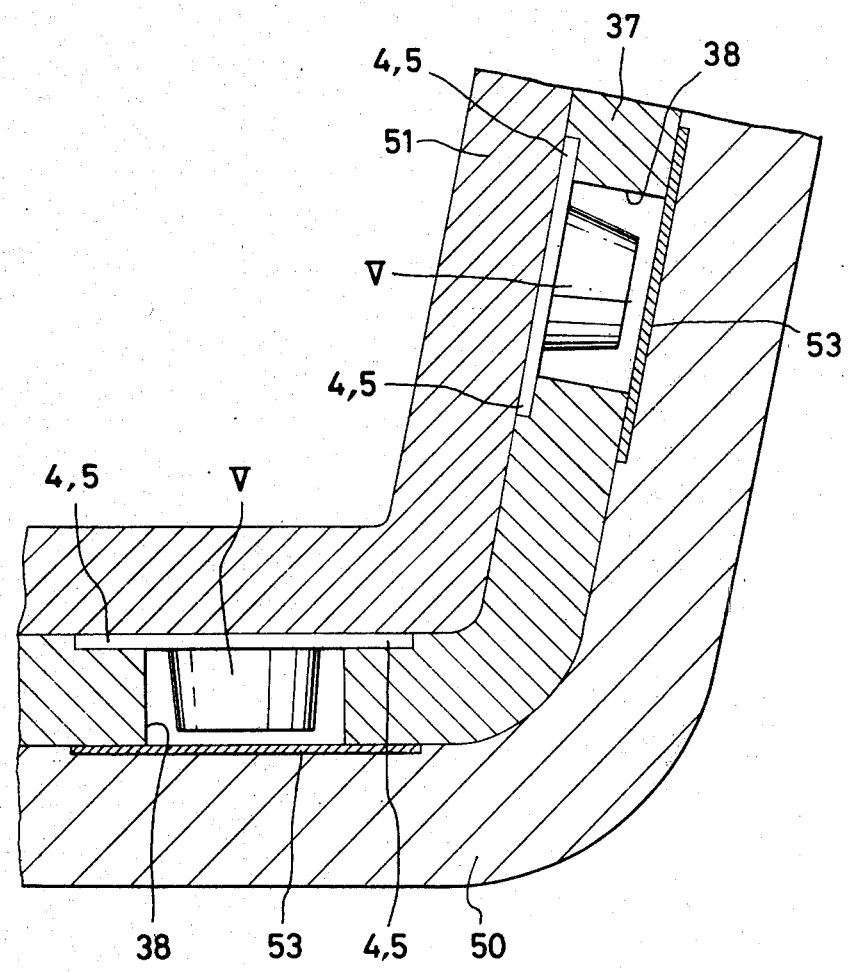

FIG. 13 is a section view illustrating the device in use.

Figure 14:
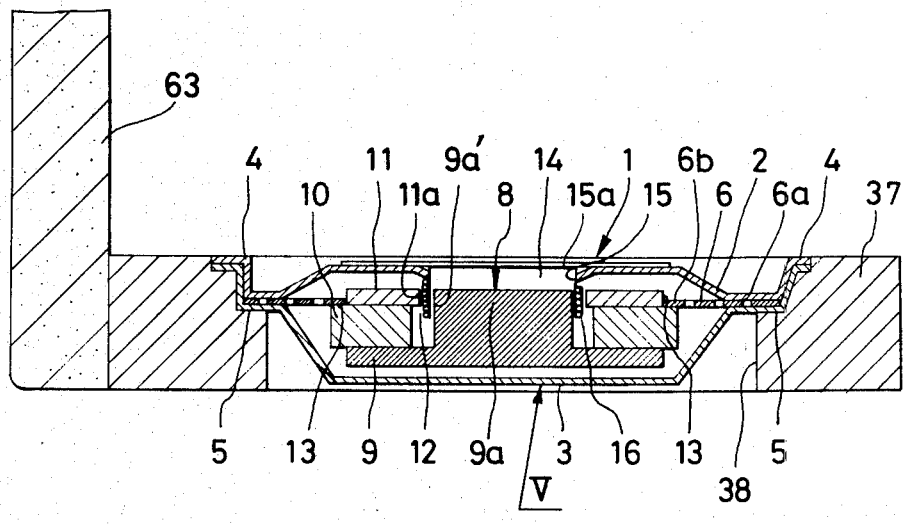

FIG. 14 is a section view illustrating the relation between the vibration plate and the electromechanical vibration converter in a different embodiment of the present invention.

Figure 15:
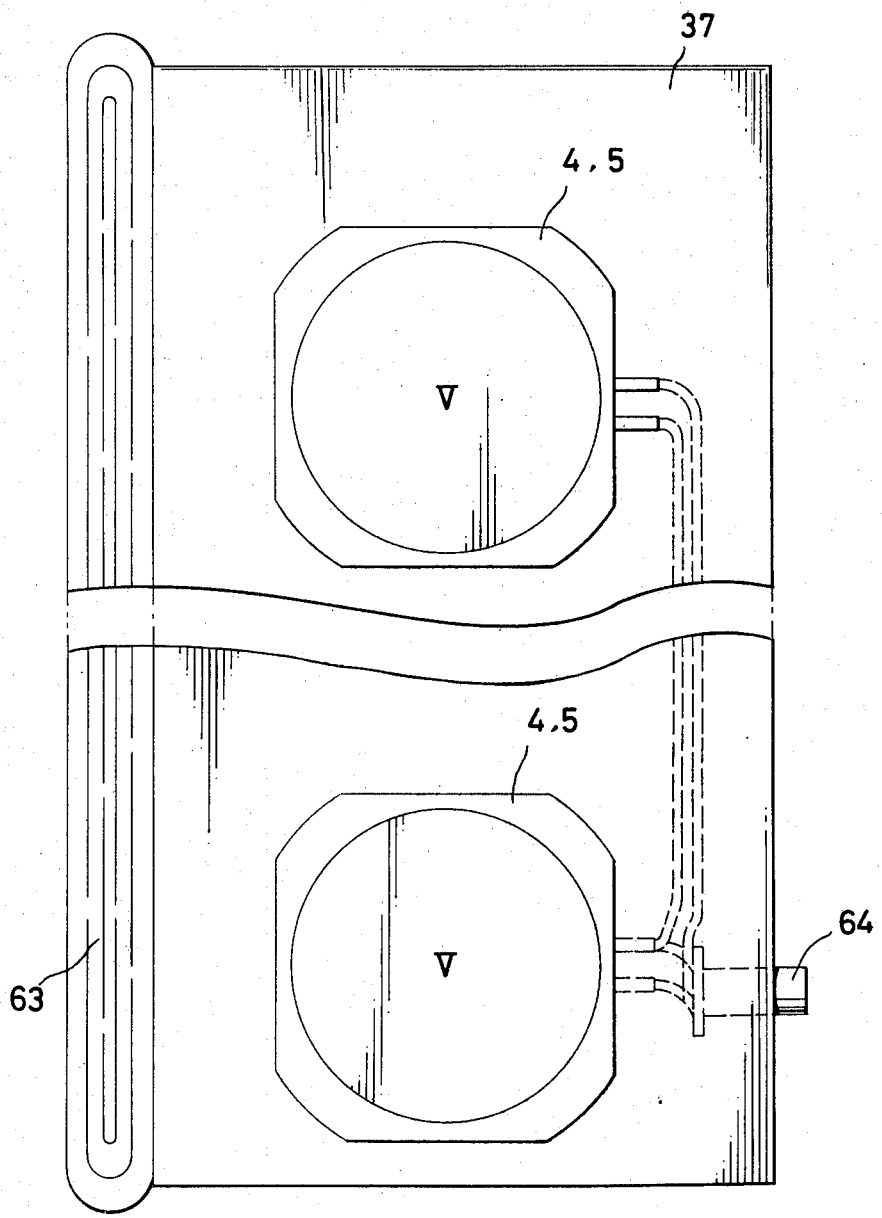

FIG. 15 is a plan view of the audio vibration device according to the present invention.

Figure 16:
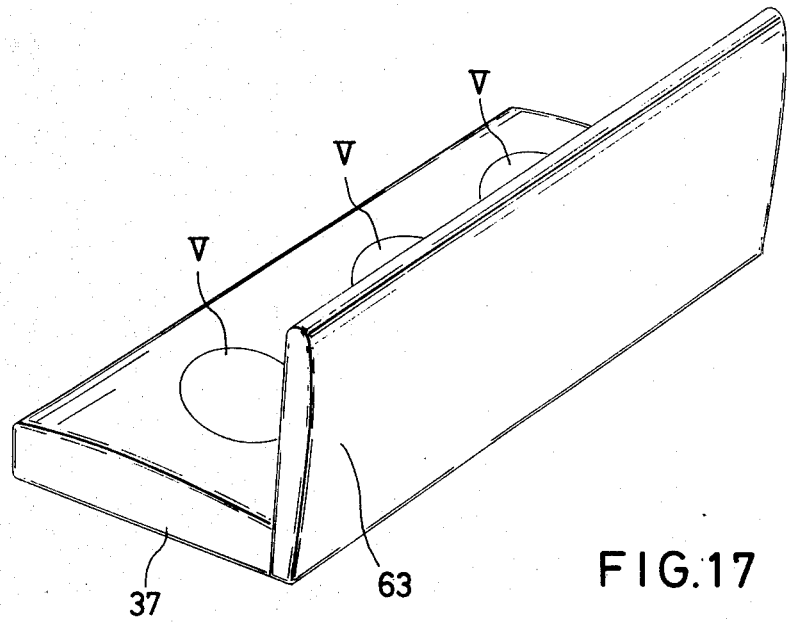

FIG. 16 is an oblique view of the audio vibration device according to the present invention.

Figure 17:
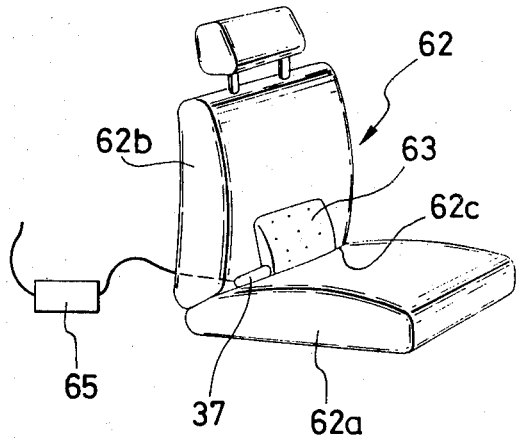

FIG. 17 is an oblique view of the device in use.

Figure 18:
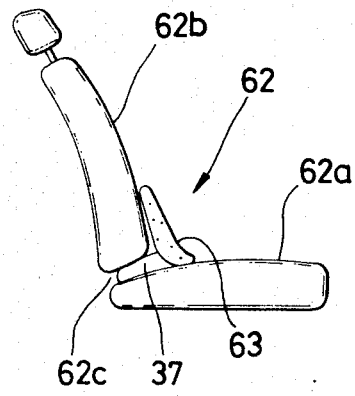

FIG. 18 is a side view of the device in use.

Figure 19:
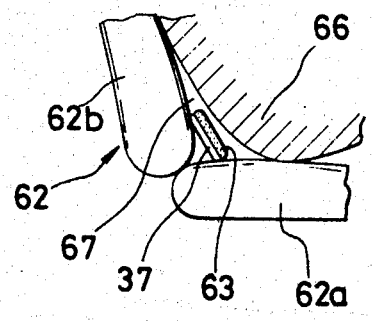

FIG. 19 is a side view illustrating a different arrangement of the audio vibration device according to the present invention.

Figure 20:
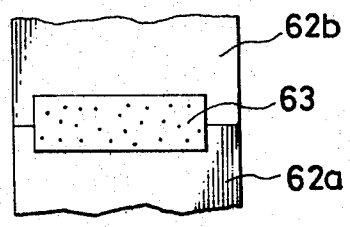

FIG. 20 is a front elevation view of FIG. 19.

Figure 21:
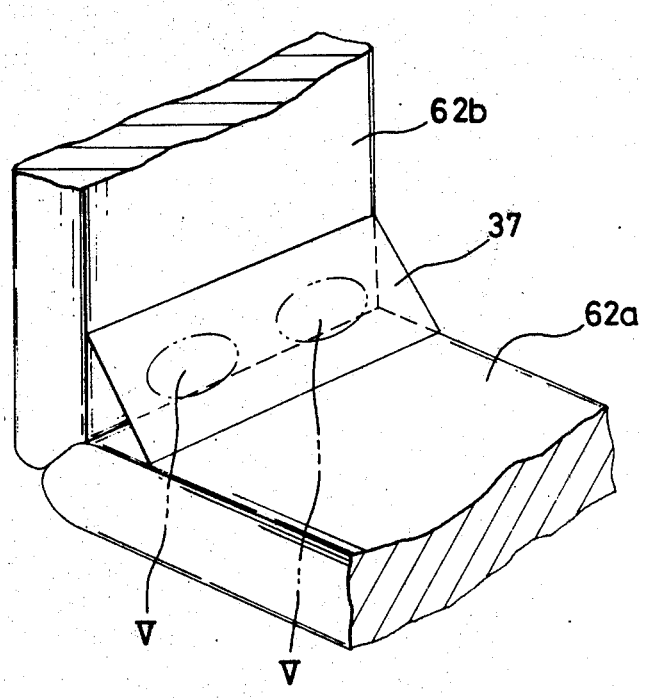

FIG. 21 is an oblique view of the vibration plate in a different embodiment of the invention.

Figure 22:
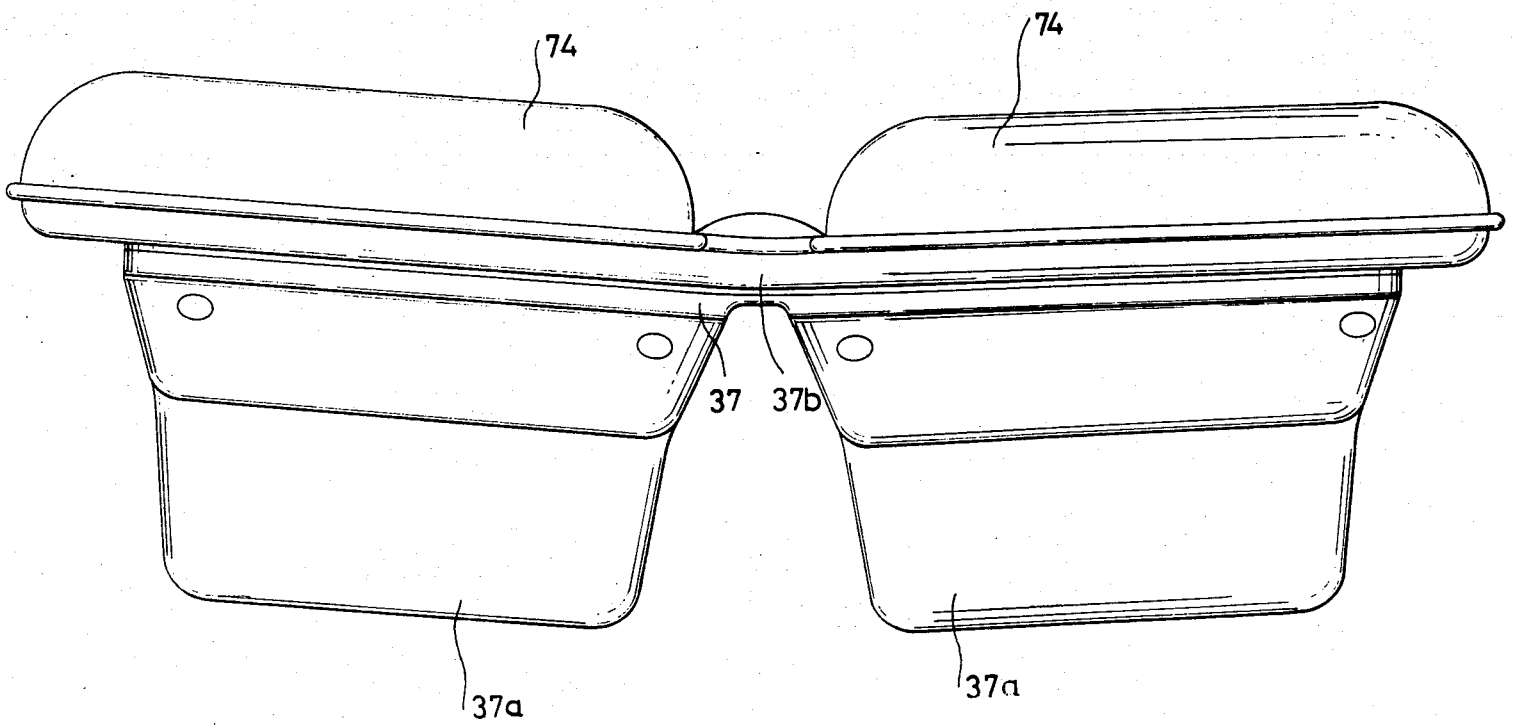

FIG. 22 is a plan view of the device in still another embodiment of the present invention.

Figure 23:
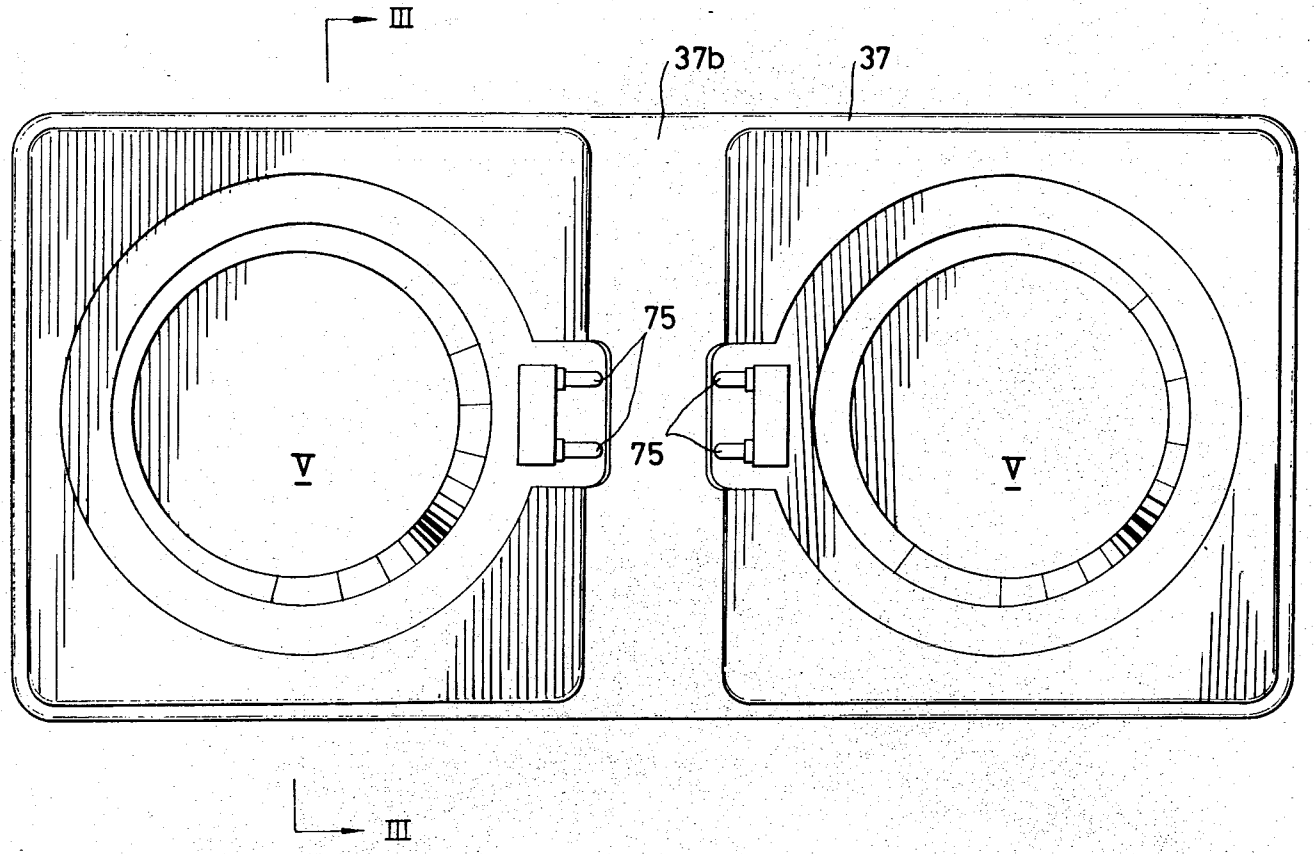

FIG. 23 is a rear side view of the device as removed of the tongue.

Figure 24:
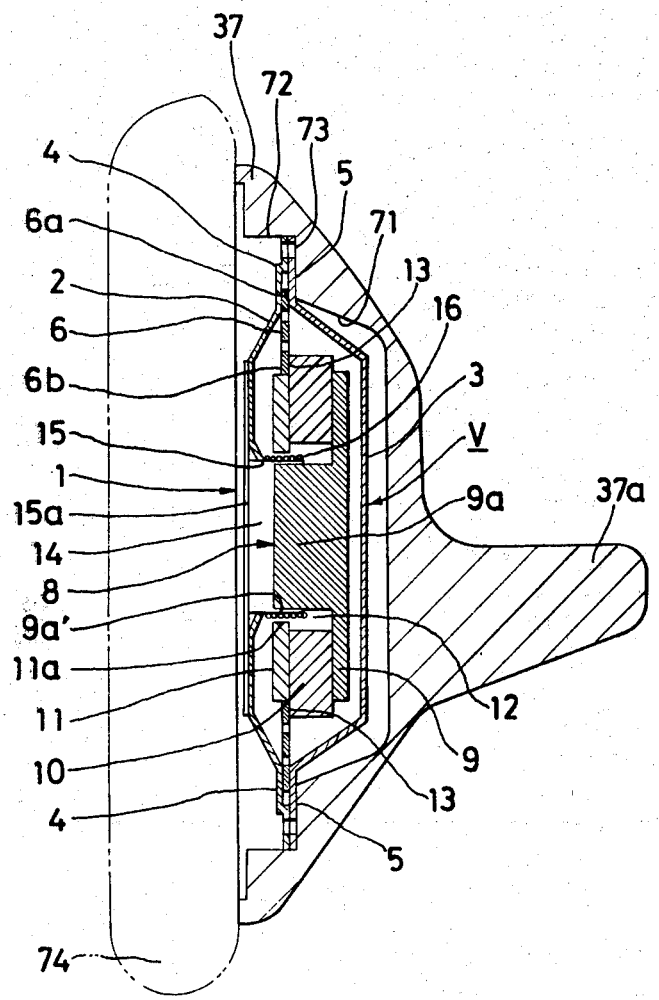

FIG. 24 is a section view of FIG. 23.

Figure 25:
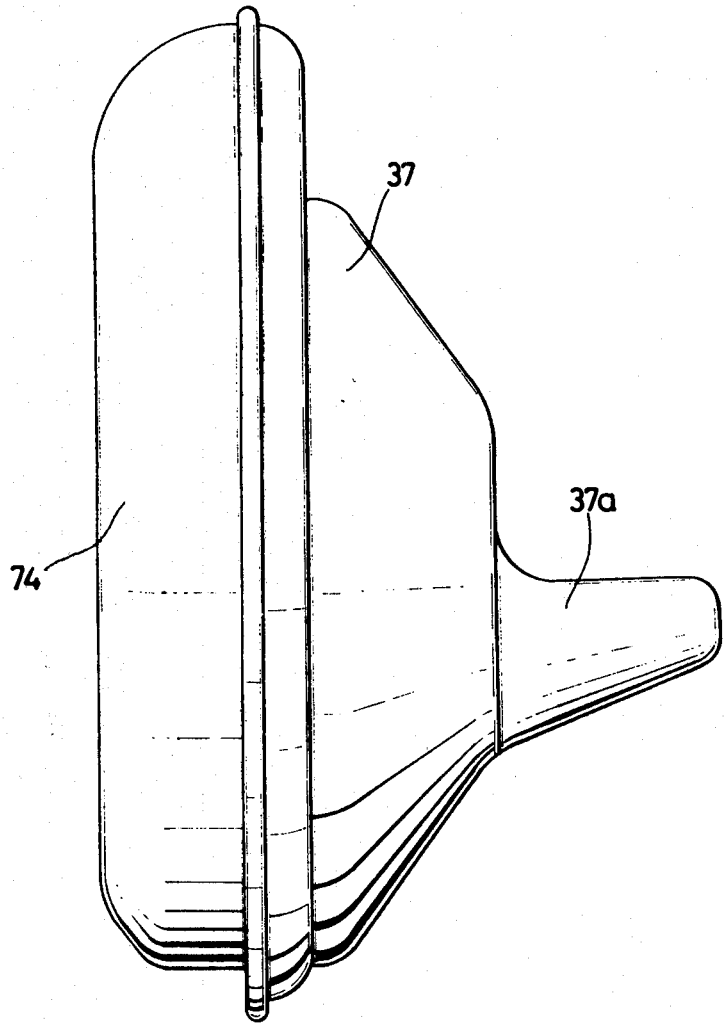

FIG. 25 is a side view of FIG. 22.

Figure 26:
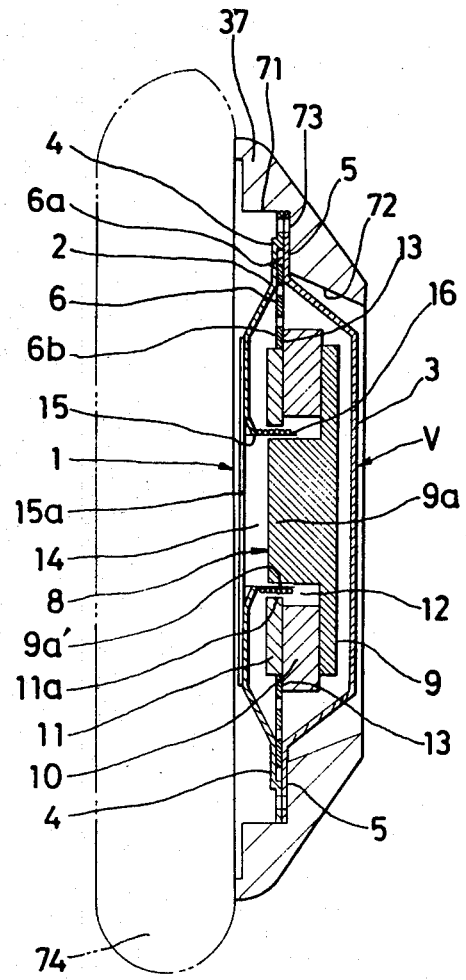

FIG. 26 is a section view along III—III of FIG. 23 showing a different embodiment.

Figure 27:
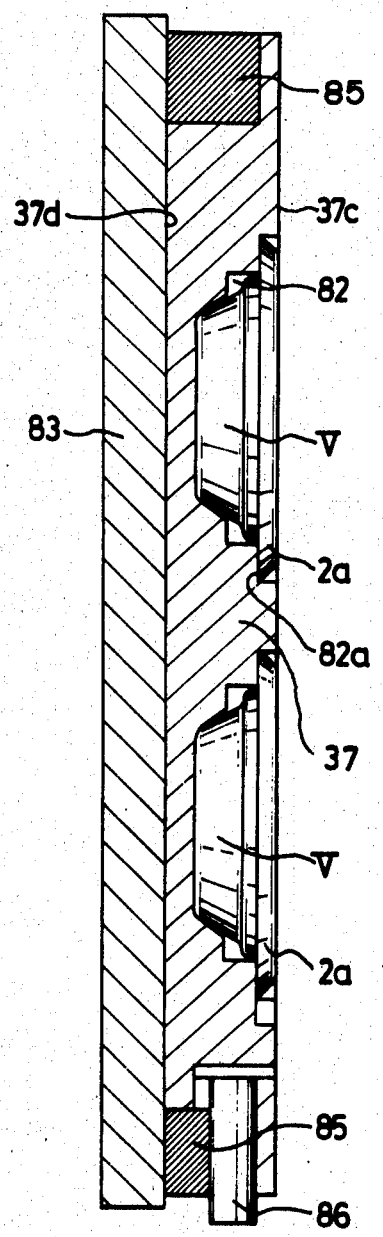
Figure 28:
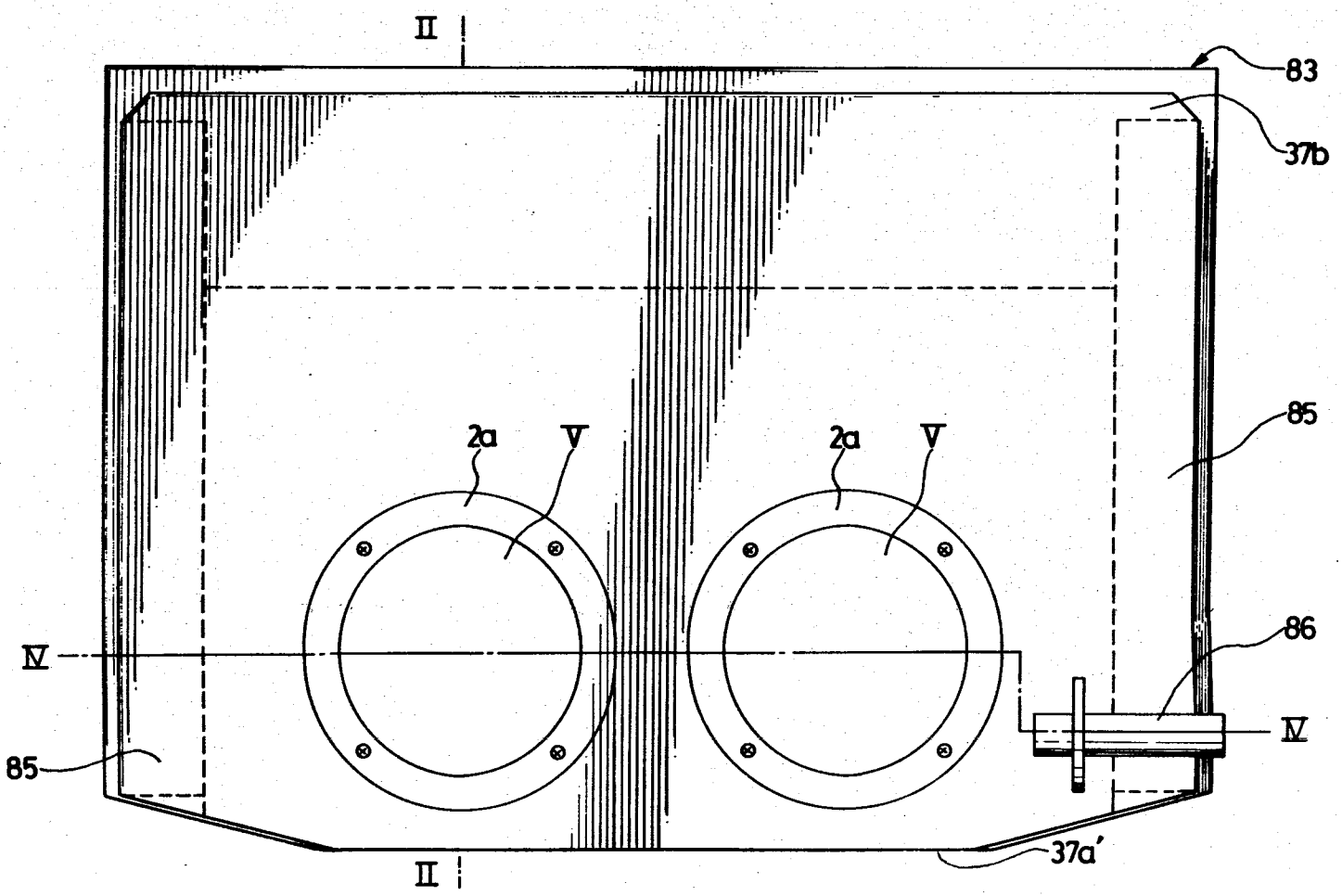

FIG. 27 is a II—II section view of FIG. 28.

FIG. 28 is a front elevation view of an embodiment of the present invention.

Figure 29:
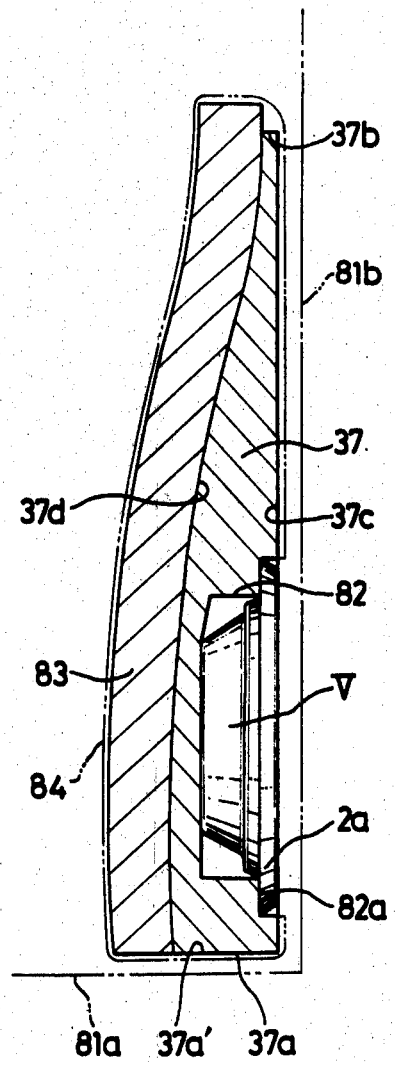

FIG. 29 is a IV—IV section view of FIG. 28.

Figure 30:
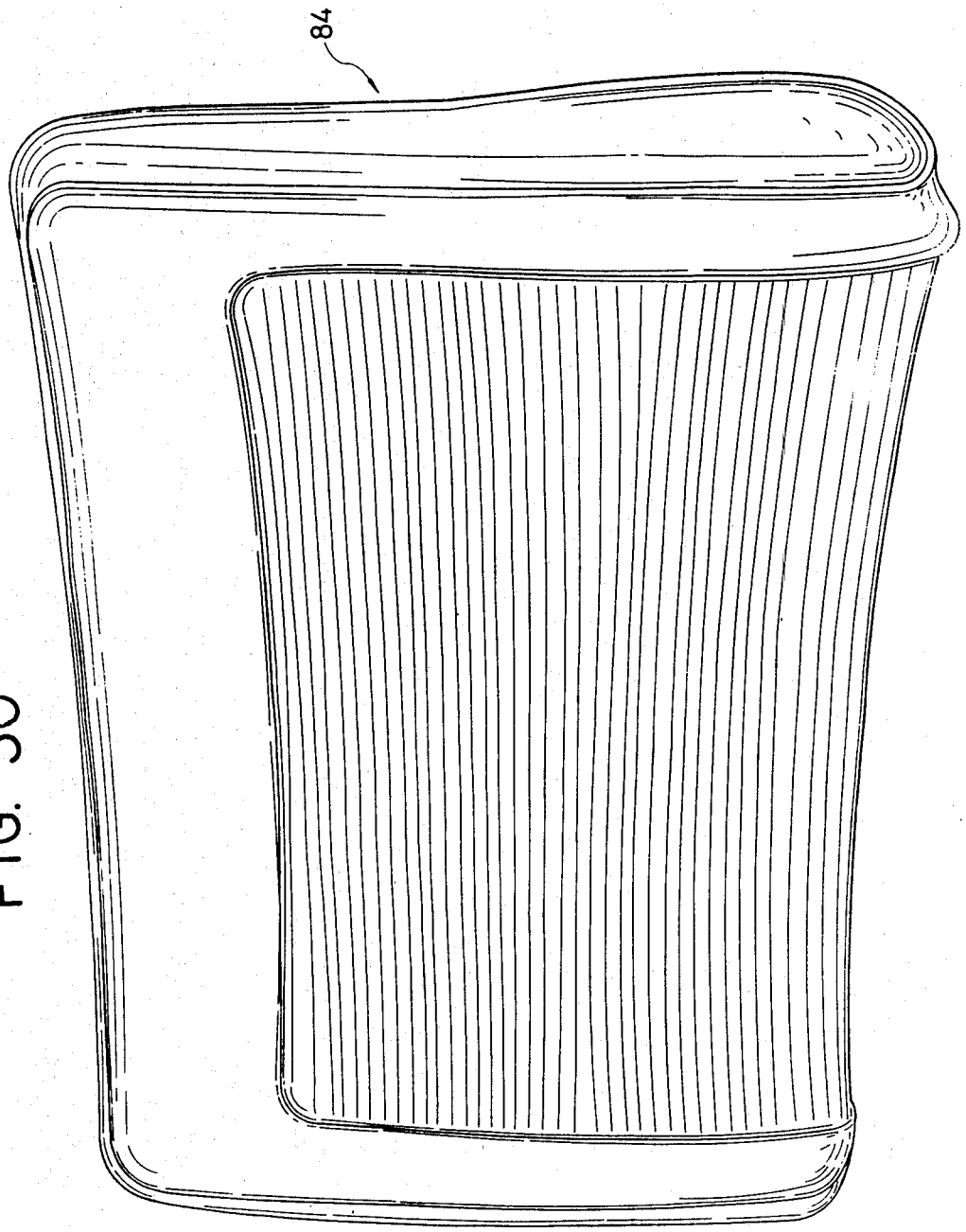

FIG. 30 is an oblique view illustrating an example of the cover.

Figure 31:
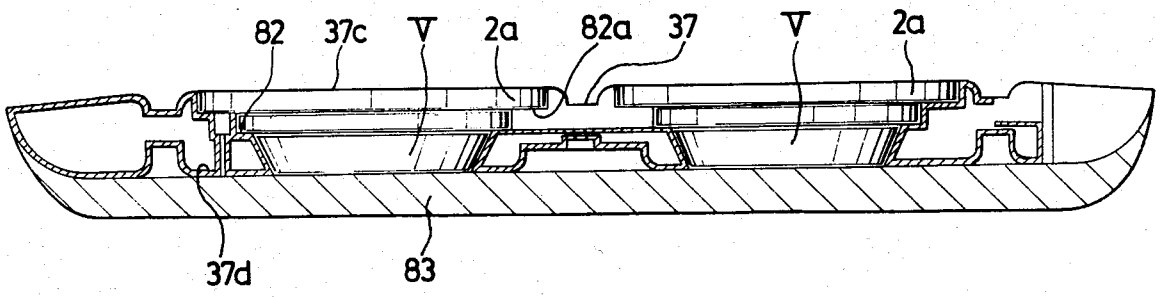
Figures 32A, 32B, 32C:
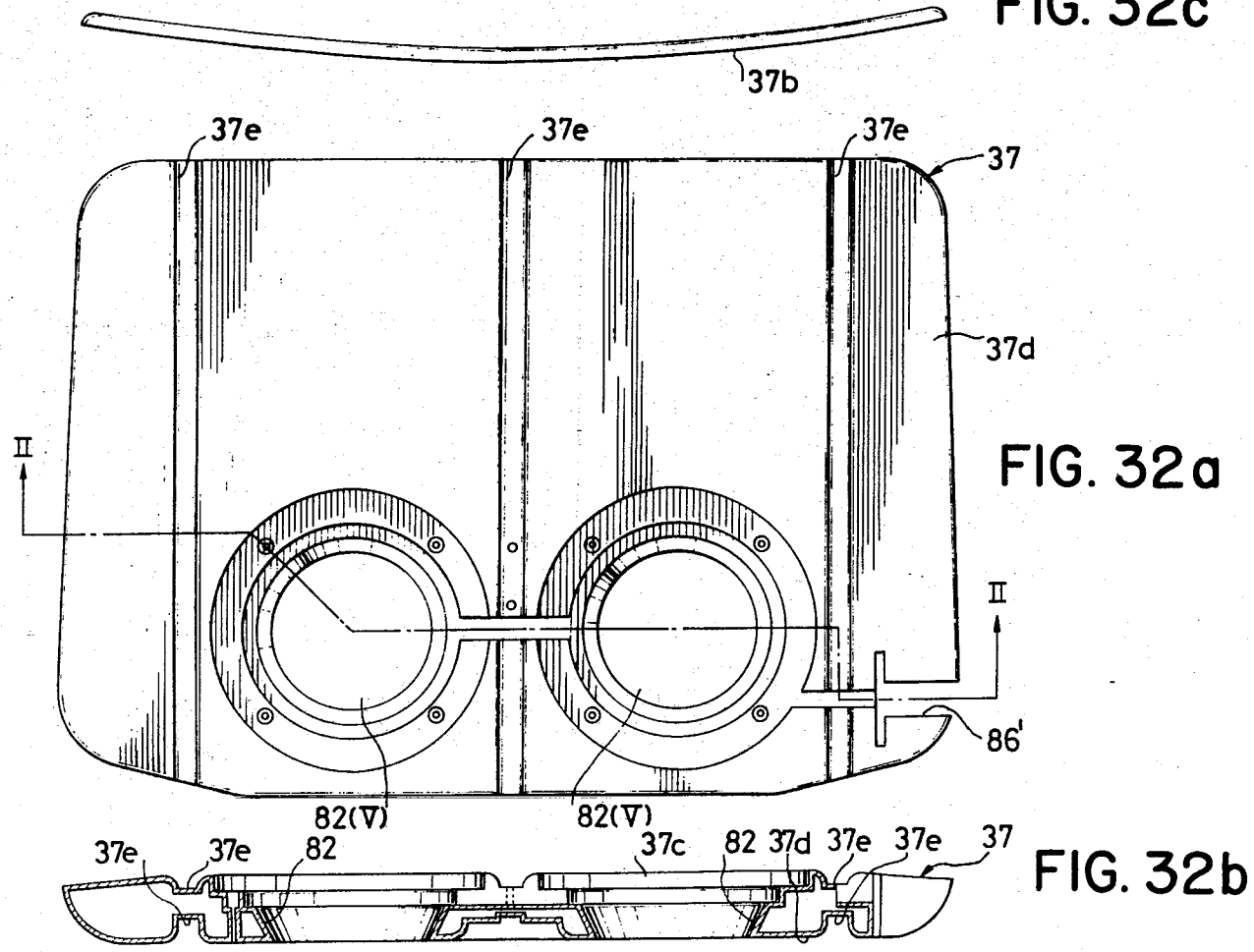

FIG. 31 is a II—II section view of FIG. 32(*a*).

FIGS. 32(*a*)~(*c*) illustrate an embodiment of the vibration plate, (a) being a backside view, (b) being a II—II section view of FIG. 31 and (c) being a plan view.

Figures 33A, 33B, 33C, 33D:
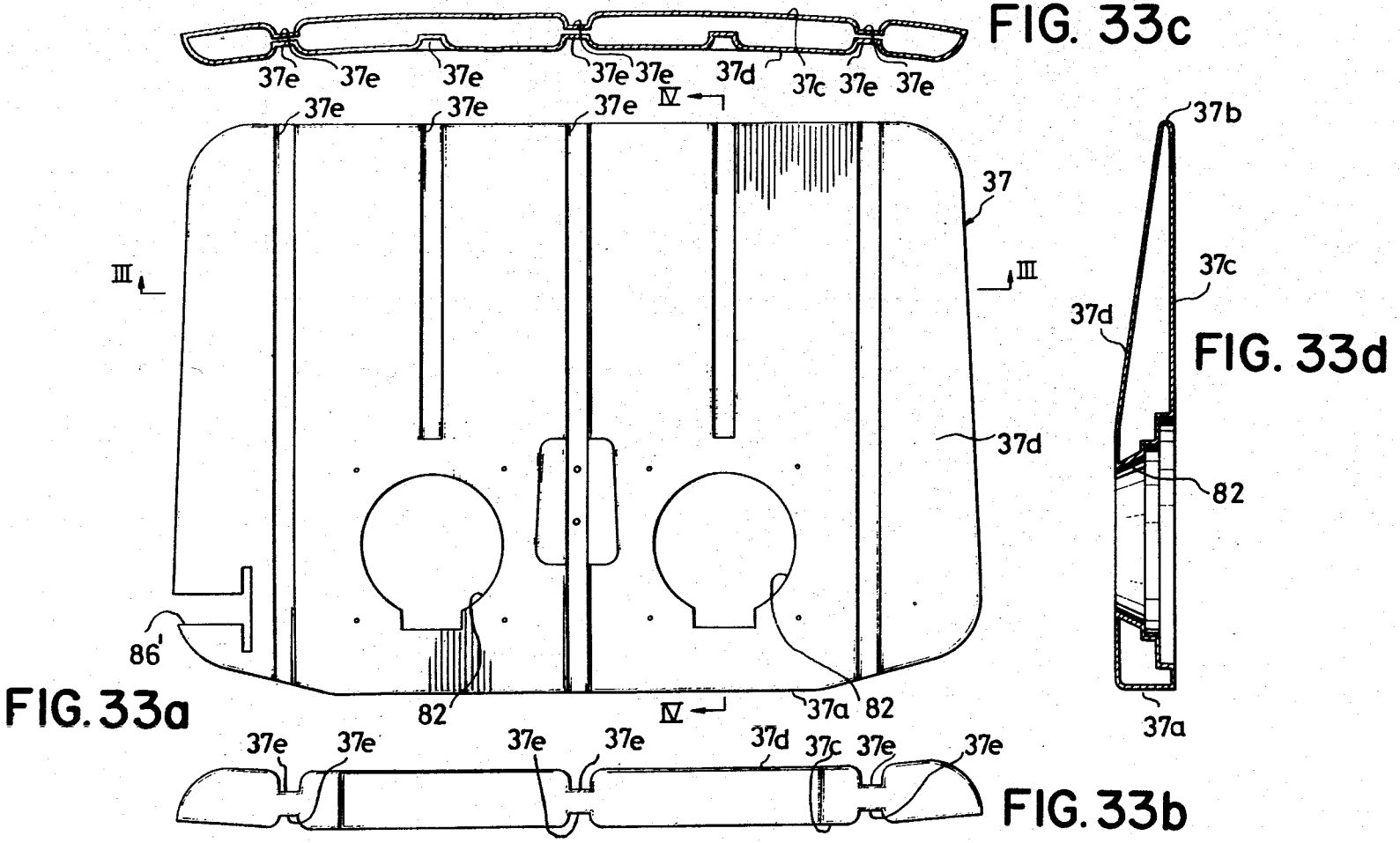

FIGS. 33(*a*)~(*d*) show views of FIGS. 32(*a*)~(*c*) as viewed from the front thereof, FIGS. 33(*a*), (*b*), (*c*) and (*d*) being respectively a front elevation view of FIG. 32(*a*), a bottom side view of FIG. 32(*b*), a III—III section view of FIG. 32(*c*) and a IV—IV section view of FIG. 33(*a*).

Figure 34:
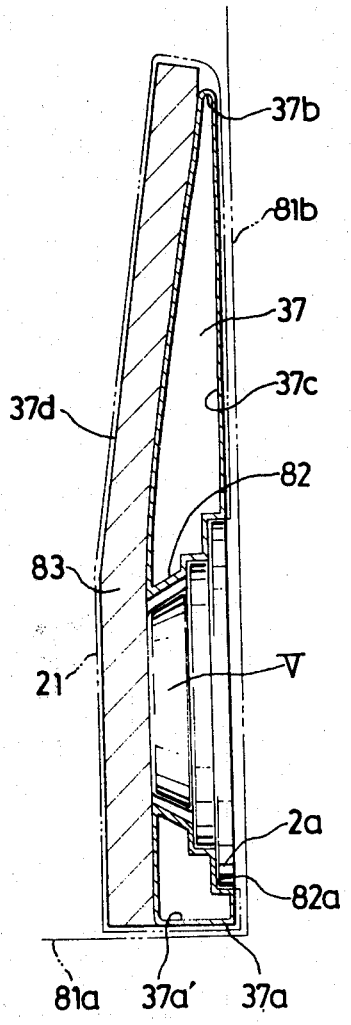

FIG. 34 is a section view of the electromechanical vibration converter being fitted into the hole of FIG. 33(*d*) and a buffer being fitted in front of the vibration plate.

Figure 35:
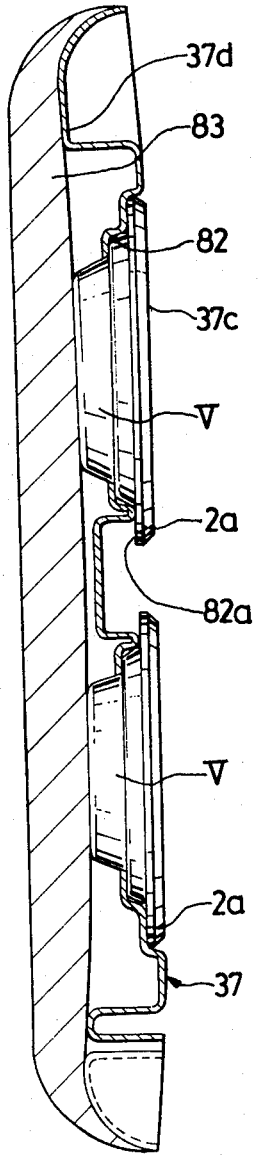
Figures 36A, 36B, 36C:
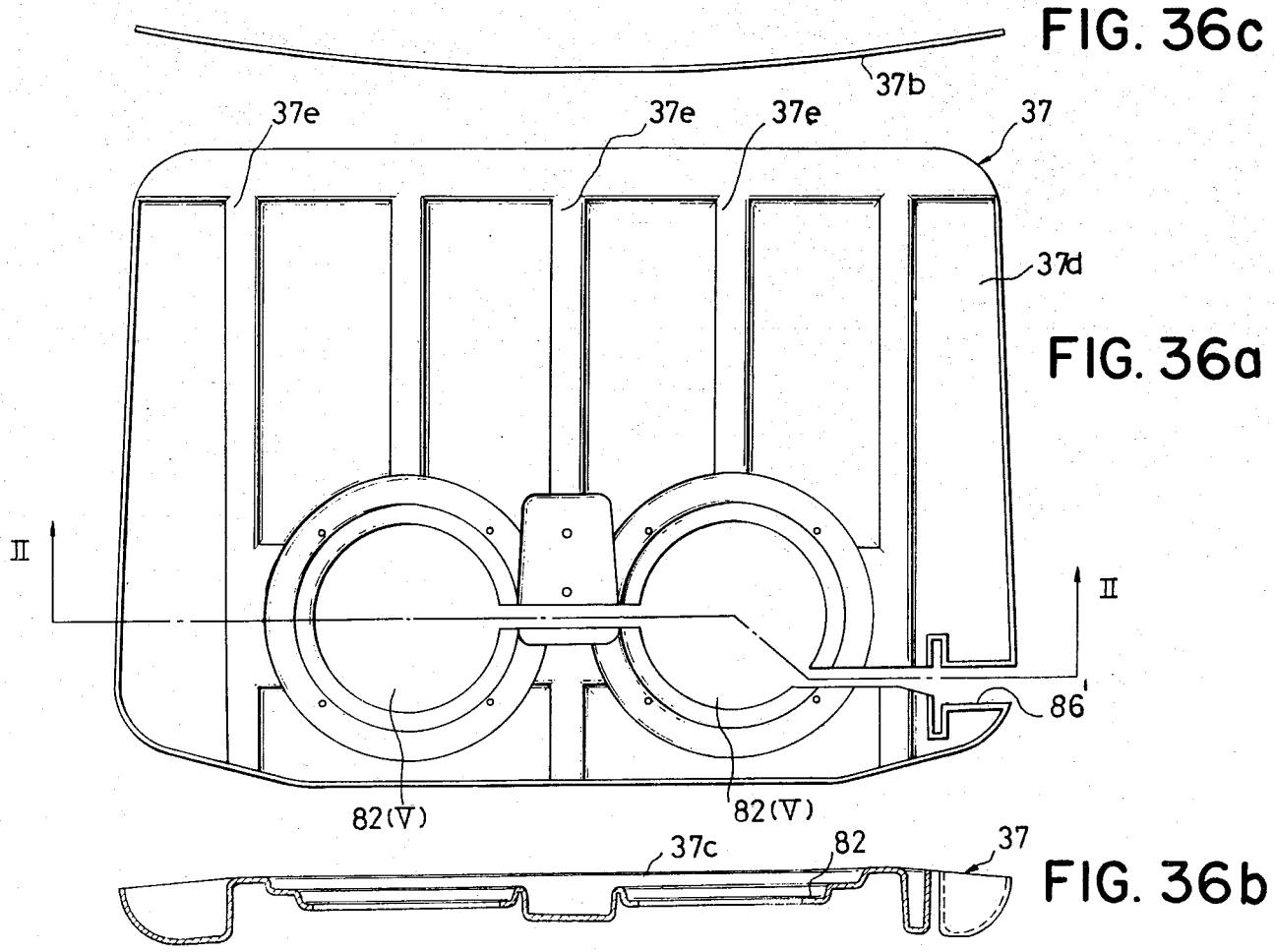

FIG. 35 is a II—II section view of FIG. 36(*a*). FIGS. 36(*a*)~(*c*) illustrate an embodiment of the vibration plate according to the present invention, (a) being a front elevation view, (b) being a II—II section view and (c) being a plan view.

Figures 37A, 37B, 37C, 37D:
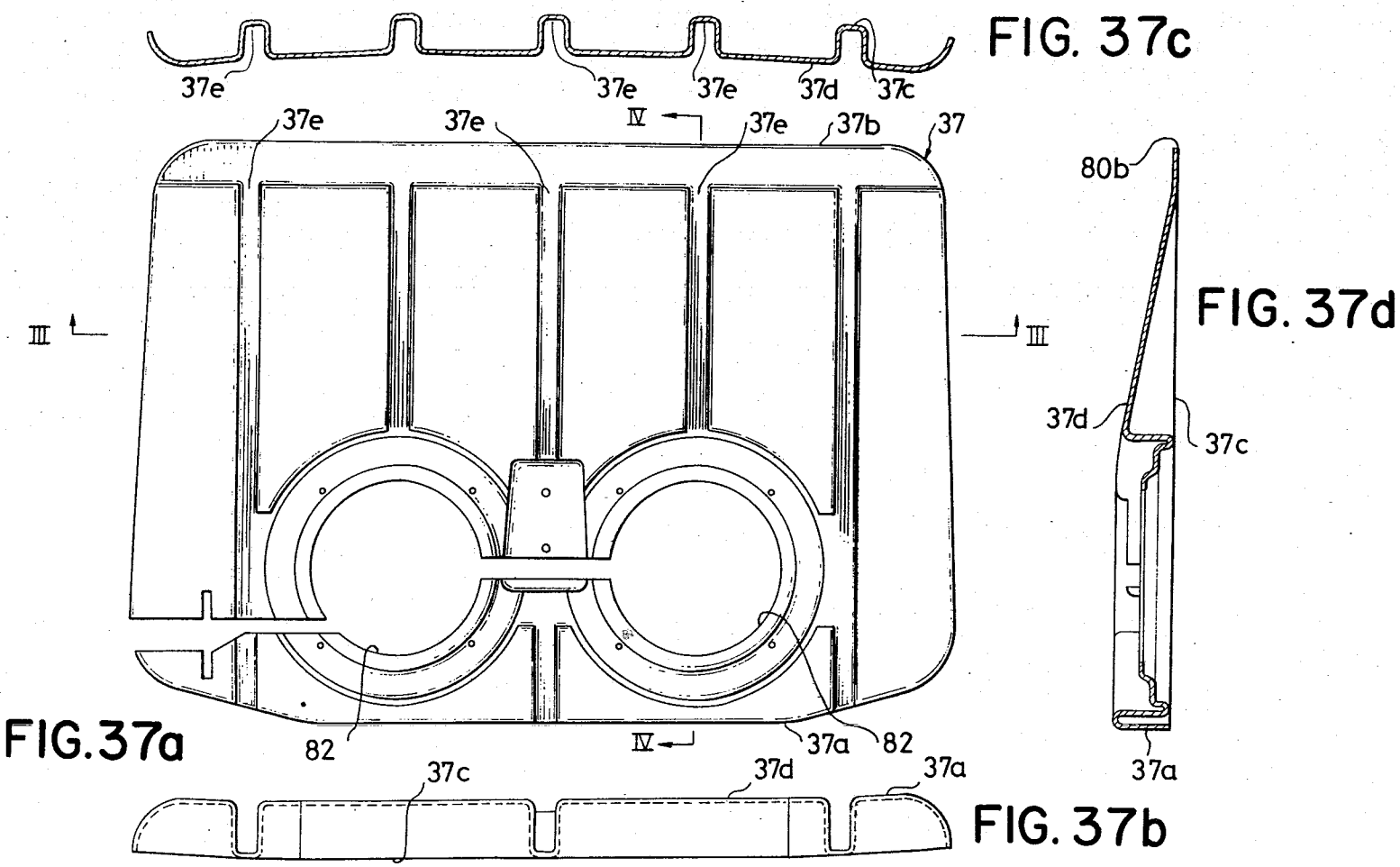

FIGS. 37(*a*)~(*d*) show views of FIGS. 36(*a*)~(*c*) as viewed from the front thereof, FIGS. 37(*a*), (*b*), (*c*) and (*d*) being respectively a front elevation view of FIG. 36, a bottom side view of FIG. 36, a III—III section view of FIG. 36 and a IV—IV section view of FIG. 37.

Figure 38:
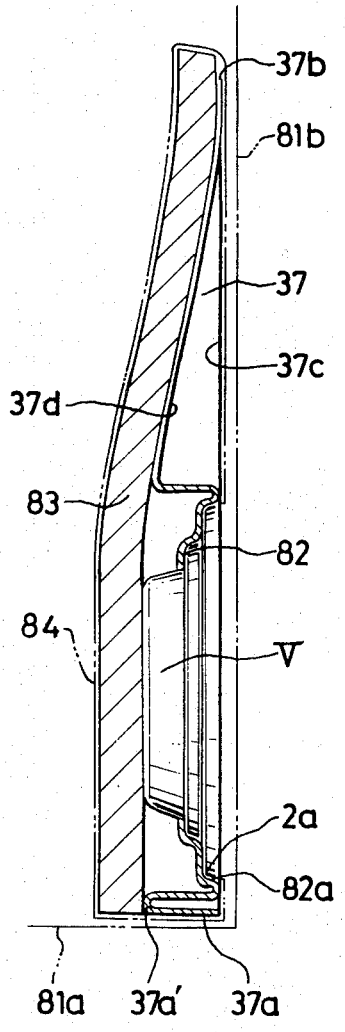

FIG. 38 is a section view of the electromechanical vibration converter being fitted into the hole of FIG. 37(*d*) and a buffer being fitted in front of the vibration plate.

Figure 39:
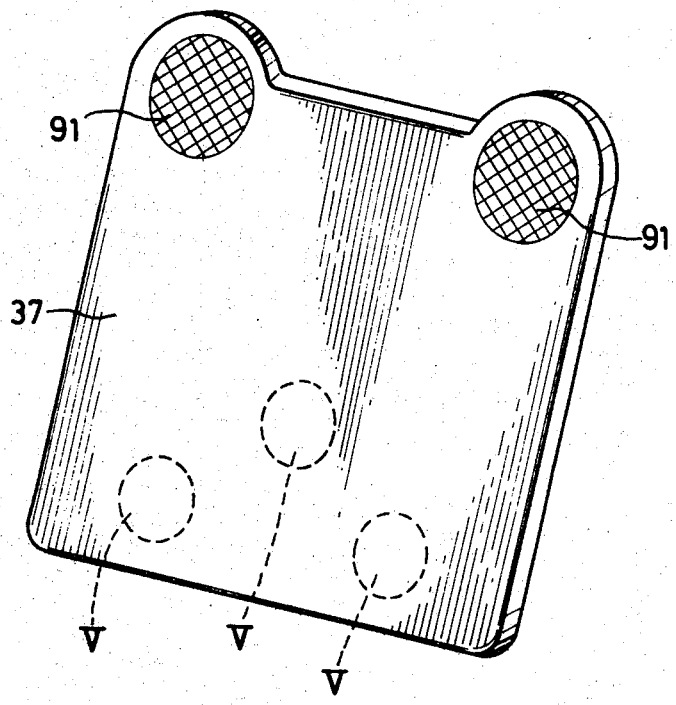

FIG. 39 is an oblique view of the vibration plate as attached with the electromechanical vibration converter and a speaker.

Figure 40:
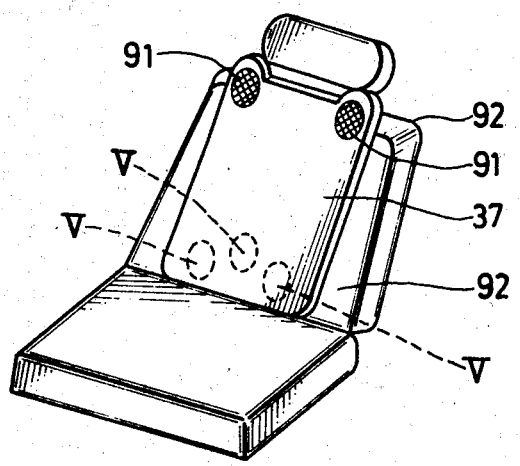

FIG. 40 is an oblique view of the device in use.

Figure 41:
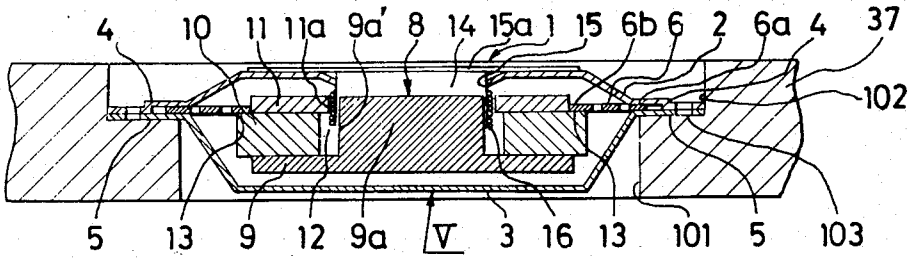

FIG. 41 is a section view illustrating the relation between the vibration plate and the electromechanical vibration converter in the present invention.

Figure 42:
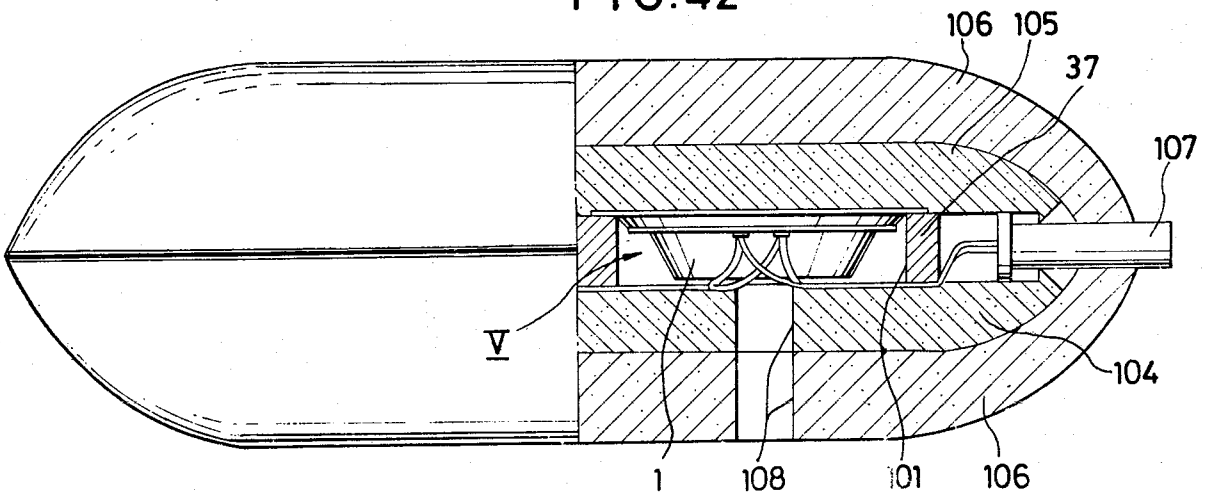

FIG. 42 is a half section view of the audio cushion according to the present invention.

Figure 43:
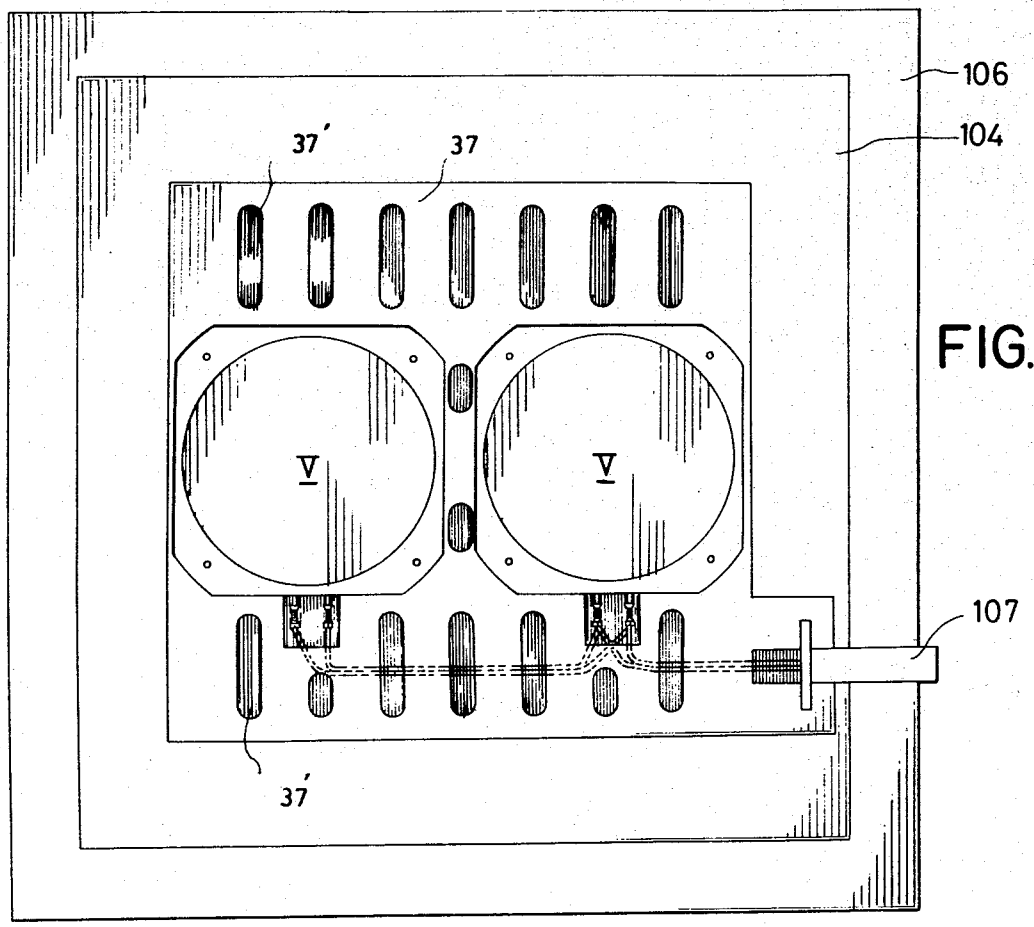

FIG. 43 is a plan view of the device as removed of the top buffer means and cushion means.

Figure 44:
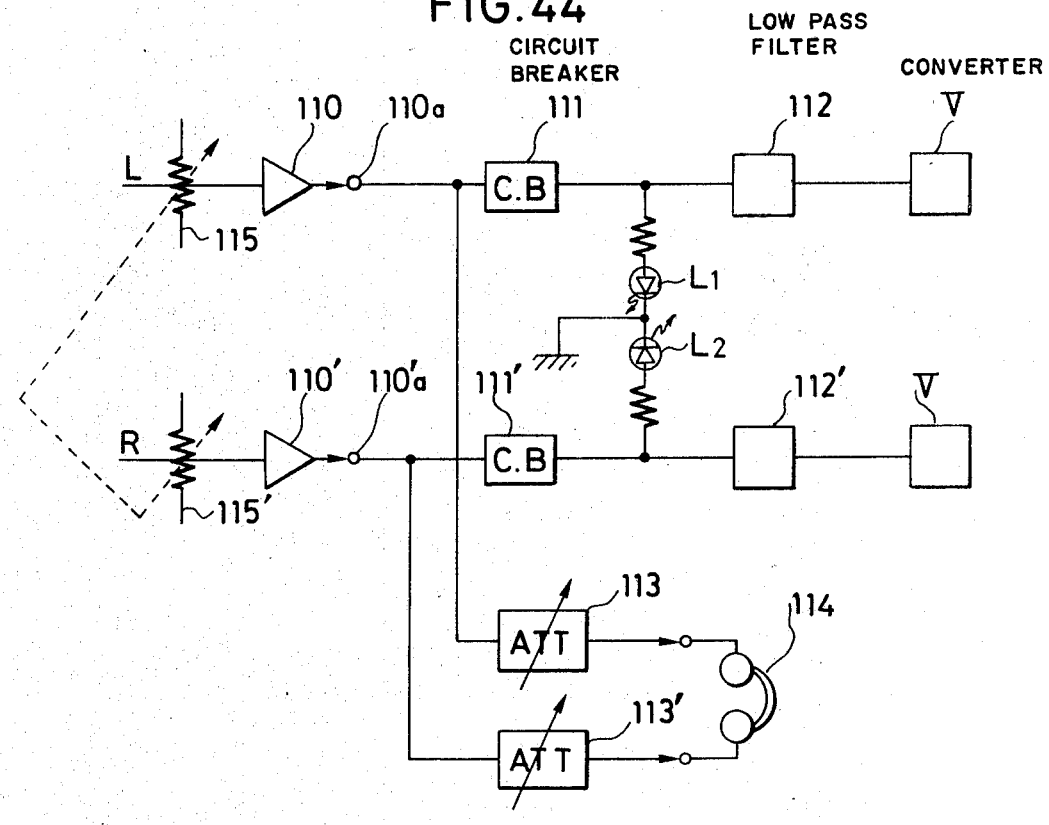

FIG. 44 is a block diagram illustrating still another embodiment of the present invention.

Figure 45:
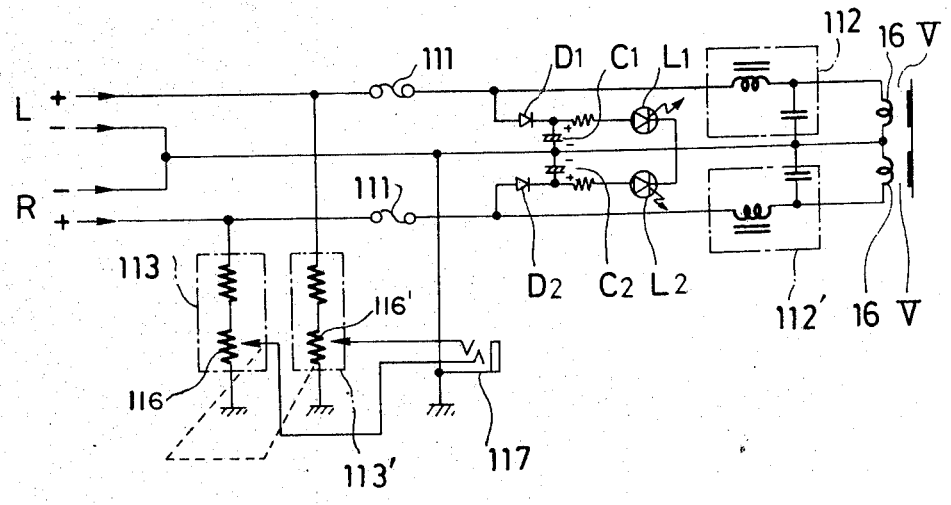

FIG. 45 is a circuit diagram in one embodiment.

Figure 1:
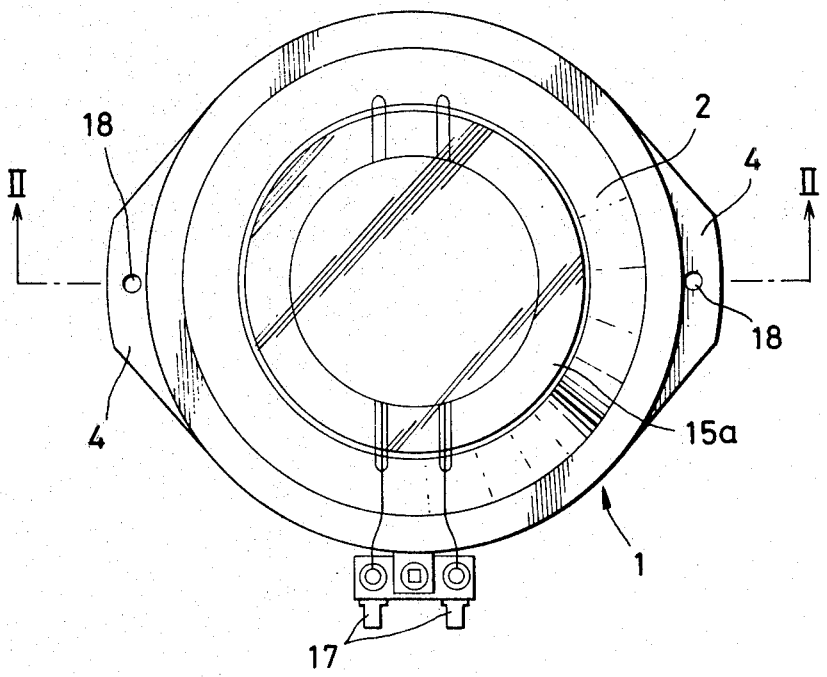
FIG. 1 is a plan view of the electromechanical vibration converter according to the present invention.

In FIGS. 1 and 2, the casing 1 of the electromechanical vibration converter consists of flat frames 2, 3 with a dish-like section. Flanged plates 4, 5 extending horizontally are integrated to the open peripheral edges of said frames 2, 3. Said frames 2 and 3 are assembled together with their open edges opposed to each other and flanges 4, 5 opposed to each other.

Between the flanges 4, 5 of said frames 2, 3 is squeezed the outer edge 6*a* of an annular damper 6 made of elastic material, the inner edge 6*b* of said damper 6 extending in the opposite direction to the flanges 4, 5, i.e., in horizontal direction into the frames 2, 3.

Next, a yoke with a permanent magnet 10, which is to be set in the casing 1, is to be described. The yoke 8 consists of a bottom plate 9 with a central pillar 9*a* and an annular top plate 11. The permanent magnet 10 is located between the bottom plate 9 and the top plate 11 and is attached thereto and is located in spaced relation to pillar 9*a*. A magnetic annular gap 12 is formed between inner edge 11*a* of said top plate 11 and outer edge 9*a*' of the pillar 9*a* of the bottom plate 9. A magnetic circuit with a magnetic gap 12 is constituted of the bottom plate 9, the permanent magnet 10 and the top plate 11. The inner edge 6*b* of the damper 6 is integrated to the stepped part 13 formed by the outer edge of the top plate 11 and the end of the permanent magnet 10 and said damper 6 permits relative displcement between the casing 1 and the yoke 8, so that the yoke 8 can be supported on a plane containing the gap 12 in the casing 1.

In the present embodiment, the damper 6 is integrated to the stepped part 13 formed by the top plate 11 and the permanent magnet 10 so that the yoke 8 can be supported on a plane containing the gap 12 in the casing 1, but the arrangement is not restricted to this one. Any arrangement will do, so long as the damper 6 is located within a plane containing the gap 12, and its outer edge 6*a* can be fastened to the casing 1 and its inner edge 6*b* can be fastened to the yoke 8. The most desirable arrangement will be such that the yoke 8 is supported by the damper 6 in the casing 1 at a position in a plane containing the gap 12, said plane being orthogonal to the axis of the gap 12 (extending vertically in FIG. 2) and passing through the center of thickness of the gap 12 in vertical direction in FIG. 2.

At the center of said frame 2 there is formed an opening 14, into which a tubular coil frame 15 attached to the plate 15*a* fits. Said coil frame 15 and plate 15*a* are integrated to the frame 2, and the coil 16 wound on the coil frame 15 is set in the gap 12.

17 denotes terminals connected to the coil 16. 18 denotes a screw hole for fitting the casing 1 to a vibration plate (not shown) placed within a cushion or the like.

An audio-band electromechanical vibration converter thus constituted can be fitted by means of the flanges 4, 5 to a vibration plate built into a chair or a cushion. When an electric signal to drive the speaker of an audio device is given via a low-pass filter to the coil 16, a magnetic interaction developed between the magnetic force generated in the coil 16 and the magnetic force of the permanent magnet 10 causes a body-felt vibration through relative displacement between the yoke 8 supported through the damper 6 in the casing 1 and the casing 1 and this vibration is transmitted via the frames 2, 3 to the vibration plate. Thereby the body-felt vibration is produced by a reproduced electric signal and accordingly it is synchronized with the audio signal which is recognized by the ear; and since it is based on a low-band electric signal, it is effective as a vibration for recognizing double bass sound. A more desirable vibration effect will be gained by changing the material quality of thickness of the damper 6. The cut-off frequency of the low-pass filter, though it depends on the sound source, is desirably 150 Hz or thereabout.

Figure 3:
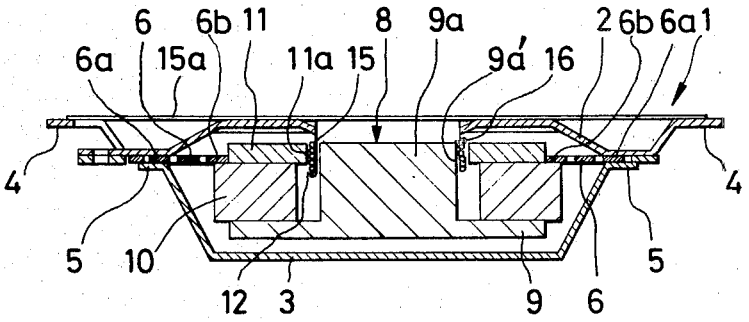
Figure 4:
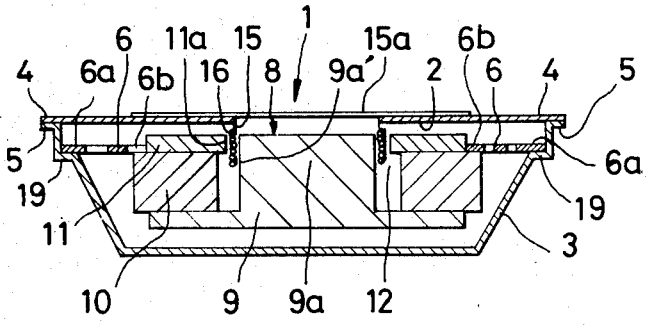
Figure 5:
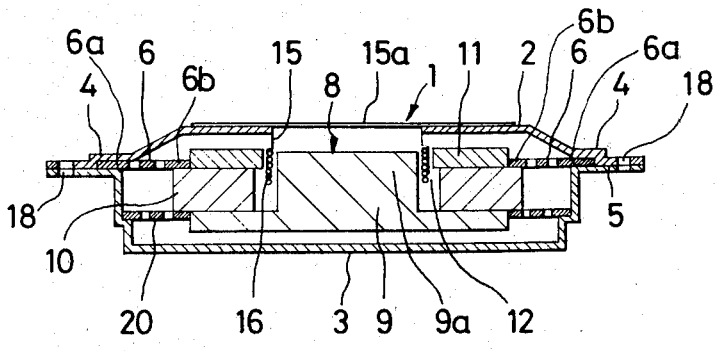
Figure 6:
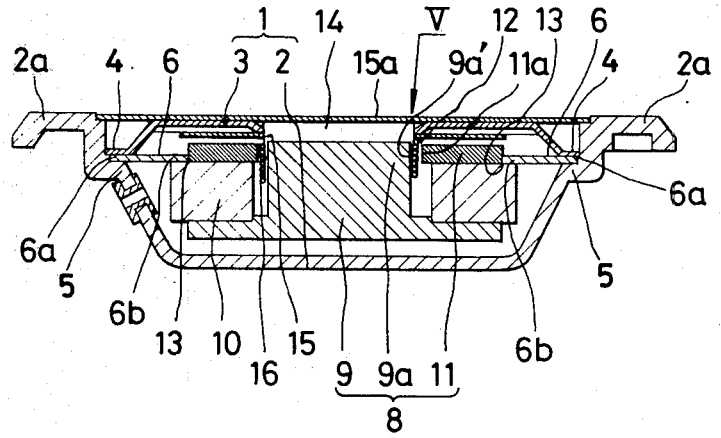

In the present example the frame 2 which constitutes the casing 1 is designed dish-like in section with flanges provided at its open edge; but as indicated in FIG. 3, it may be designed such that the open edge of the frame 2 is extended off the damper 6 to make it a flange 4 and by means of this flange 4 the casing 1 is attached to a vibration plate (not shown). The attachment of the casing 1 to the vibration plate may be direct or indirect through another member which effectively transmits the vibration. In the present example the damper 6 with its outer edge 6a held between the flanges 4, 5 is attached to the casing 1; but as indicated in FIG. 4, it may be designed such that a stepped part 19 is formed on the frame 3 and the damper 6 with its outer edge 6a fixed to this stepped part 19 is attached to the casing 1. Also in the present example, a single damper 6 located within a plane containing the gap 12 supports the yoke 8 in the casing 1; but as indicated in FIG. 5, it may be designed such that another damper 20 is added at the yoke 8 and the yoke 8 is supported in the casing 1 by the dampers 6 and 20. If the two dampers 6, 20 are used to support the yoke 8, it will be possible to appropriately establish the positional relation between the gap 12 and the coil 16 by the damper 6; or it may be designed, as indicated in FIG. 6, such that the flange 5 of a horizontal plate extending at the open edge of the frame 2 is integrally provided; a thick edge is given to the frame 3; a flat part 4 opposing the flange 5 is placed inside of said edge 3a; and the flange 5 and the flat part 4 face each other, with the frame 2 assembled inside of the edge of the frame 3.

In the present example an external magnet system is employed to constitute a magnetic circuit with a magnetic gap 12, but an internal magnet system in which the permanent magnet is set at the position of the pillar 9a may be employed.

In the present example the frames 2, 3 which constitute the casing 1 are designed dish-like in section, but the flat frames 2, 3 can have any sectional profile so long as the yoke 8 can be held in the casing 1 such that a relative displacement is permitted between the yoke 8 supported by the damper 6 and the casing 1.

Thus in the electromechanical vibration converter according to the present invention a yoke with a magnetic pole is supported in the casing at a position on a plane containing the gap formed by said yoke; therefore even if a load falls on the damper which supports the yoke, the relative displacement between the gap and the coil can be minimized; and accordingly the fitting position of the casing has no effect on the coil position, making it possible to convert the low-band audio signal to a vibration with fidelity.

Since the yoke is provided within the case in such a manner that a relative displacement between yoke and casing is permitted, the minimum necessary space for the yoke to displace in the casing will suffice. Moreover, since the casing itself is attached to the vibration plate, there is no need for erecting a screw stem as in the conventional practice and thus the converter as a whole can be made thin.

FIGS. 7~9 illustrate an embodiment of a device to drive the electromechanical vibration converter.

In FIG. 7, 21 denotes a mixer for mixing the audio signals from the right and left channels of the amplifier in a stereophonic device. To the output side of said mixer 21 is connected a low-pass filter 22 of the first stage. The cut-off frequency of said low-pass filter 22 is set at about 150 Hz.

To the output side of said low-pass filter 22 is connected a limiting amplifier 23 which acts such that the magnitude of the output can be limited to a specific value for an input of more than a specified magnitude. Thus said limiting amplifier 23 prevents the converter from being impressed with an excessive power.

25 denotes the low-pass filter of the second stage, which serves to eliminate an angle and correct a distortion of the audio signal cut off by the limiting amplifier, when its wave form becomes rectangular. The cut-off frequency of said low-pass filter 25 is set at about 150 Hz.

26 denotes a power amplifier to amplify a signal from the low-pass filter 25, the voltage gain being OdB.

FIG. 8 is a specific electric circuit diagram illustrating the block diagram of FIG. 7. In FIG. 8, the mixer 21 is composed of the resistors $R_1$, $R_2$ and the variable resistor VR. VR serves to adjust the output at the terminals a, b of the converter 24.

The first low-pass filter 22 is composed of the resistors $R_1$, $R_2$ and the condenser $C_1$.

The transister $Q_1$, the resistors $R_3 \sim R_7$ and the condensers $C_2$, $C_3$ constitute an amplifier 23 of voltage feedback type, $Q_1$ acting as a limiter at the supply voltage +B.

Meanwhile the second low-pass filter 25 is constituted by negative feedback from the condenser $C_2$ and these low-pass filters $F_1$, $F_2$ constitute the low-pass filter 22 of the first stage.

The resistors $R_8 \sim R_{10}$, the condensers $C_4 \sim C_6$ and the field effect transistor (FET) $Q_2$ constitute a low-pass filter 25 of the second stage.

The resistors $R_{12} \sim R_{16}$, the condenser $C_7$, the diodes $D_1$, $D_2$ and the transistors $Q_3 \sim Q_6$ constitute a power amplifier 26, which is a genuine complementary emitter-follower with a voltage gain OdB. The resistor $R_{11}$ is a boot strap type.

In this case, the signals from the right and left channels are blended into a single signal in the mixer 21 and only a low-frequency band signal can pass the low-pass filter 22. The passed signal is made an appropriate output signal for the electromechanical vibration converter by the limiting amplifier 23. Any distortion in the output waveform of the amplifier 23 can be corrected by the low-pass filter 25; and the output, after power-amplified by the amplifier 26, is supplied from the terminals a, b to the converter 24. Since the output is limited by the limiting amplifier 23 and the voltage gain at the amplifier 26 is OdB, not only the converter 24 but also the amplifiers 23, 26 are protected from impression with excessive power.

FIG. 9 illustrates a different embodiment of the present invention. Whereas in the preceding example the limiting amplifier 23 is adopted as the limiting means, in the present embodiment a limiter 27 is constituted by a diode; and in this stage, the necessary power for the amplifier 26 is secured by cutting off the output at a specific value without amplifying the input. The cut-off output from the limiter 27 is decided considering the mechanical strength of the converter 24.

In FIGS. 7 and 9 between the mixer 21 and the low-pass filter 22 or between the low-pass filter 22 and the limiting amplifier 23 or the limiter 27 there may be connected a delay circuit 28 so that a phase shift due to a separated arrangement of the speaker and the converter can be prevented.

As the result of the output from the amplifier of the stereophonic device being thus limited depending on the strength of the converter, not only the converter is protected from damage, but also the amplifier is protected from direct impression with the output from the exclusive amplifier for the stereophonic device. Further as the signal goes through two stages of low-pass filters, a distortion in the signal waveform can be corrected and no disagreeable sensation is caused.

The relation between the above-mentioned converter and the vibration plate is now to be described referring to the drawings.

An embodiment illustrated in FIGS. 10 and 11 is characterized in that the converter is embedded in the vibration plate and the vibration plate itself spreads the load falling on itself, thereby making the whole assembly thin.

The converter illustrated in FIG. 10 has the same constitution as the one in FIG. 2; accordingly the same symbols are employed with no explanation for them.

37 denotes a flat vibration plate which is made of foamed product, say, foamed polyethylene with 15–20% voids. It vibrates well at low-band; is light and rigid; and has a fitting hole 38 for the converter bored thereon. Said fitting hole 38 connects to a large-diameter hole 39 with an annular stepped part 40 formed between them. The converter as fitted into said hole 38 and with the flanges 4, 5 of the casing 1 fixed to the stepped part 40 is embedded in the vibration plate 37. The vibration plate 37 is made slightly thicker than the converter. The vibration plate is itself rigid and thus it prevents the casing 1 from coming into direct contact with a rigid body.

The rigidity of the vibration plate 37 serves to distribute the load of a human body over the vibration plate 37 and makes it possible for the vibration plate 37 to vibrate effectively. In the case of the vibration plate 37 being hard, it is desirable, as illustrated in FIG. 11, that a buffer hole 41 be provided so that an audible sound due to the vibration of said plate 37 can be eliminated.

The material of the vibration plate 37 is not confined to a foamed product like foamed polyethylene; it may be anything that can vibrate well at low band, is light; and rigid enough to support and spread the load of a human body, thereby preventing the casing 1 from coming into direct contact with a rigid body.

In the present example the casing 1 is attached to the vibration plate 37 with a stepped part 40 formed thereon; but as indicated in FIG. 11 it may be arranged such that only a fitting hole 38 is provided so that the flanges 4, 5 of the casing 1 can be directly fitted to the surface of the vibration plate 37.

In FIG. 11 two converters are employed, but the number of them is not confined to two.

In this example, the vibration plate 37 is coated with a springy material like urethane foam or rubber to prevent its direct contact with the floor surface, which suppresses its vibration; and thus coated, the vibration plate is assembled into a cushion, a bed or a chair.

When an audio signal to drive the speaker is given via a low-pass filter to the coil 16, magnetic interaction happens between the magnetic force generated in the coil 16 and the magnetic force of the magnetic gap 12 and in consequence a body-felt vibration is caused through relative displacement between the yoke 8 supported in the casing 1 and the casing 1. This vibration is transmitted through the casing 1 to the vibration plate 37. As the result the vibration plate 37 vibrates and this vibration is synchronized with the audio signal, which is heard by the ear; and since this is based on a low-band audio signal, it is effective as a vibration for appreciation of double bass sound. By changing the material quality or thickness of the damper, a more desirable vibration effect can be obtained. The cut-off frequency of the low-pass filter, which depends on the sound source, is desirably about 150 Hz.

In the present embodiment, when a human sits on the vibration plate 37, his load is spread by the plate itself and the casing 1 is prevented from protruding above the plate 37, as the result of which it comes into a rigid body and has its vibration suppressed. Since the load is spread, the plate 37 can effectively vibrate.

In the present embodiment the converter is designed such that the yoke and the casing can make relative displacement and an output is taken out of the casing; and this converter is embedded in the vibration plate. Therefore the thickness of the vibration plate suffices. Meanwhile the load falling on the vibration plate is spread by the plate itself. Therefore any separate member to support the vibration plate is rendered needless, thereby making the whole assembly thin. Moreover, unlike in the conventional device, the converter does not jut out above the vibration plate, only a space enough to hold the vibration plate suffices and no limitation is imposed on the fitting position.

An example illustrated in FIGS. 12 and 13 is a commercially available seat means for humans which can be used as audio equipment by merely setting on a piece of furniture fitted with a cushion means on the surface side.

The relation between the converter and the vibration plate in this example is the same as in FIG. 10. The vibration plate 37 in this example is made of a foamed product like foamed polyethylene with the extent of foaming of 20–30; it can well vibrate at low band; is light and rigid; and is made of such a flexible material as can be applied following the contour of the cushion means 50 provided on the chair. Said vibration plate 37 has a fitting hole 38 bored therein; and the converter as loosely fitted into said hole 38 and with the flanges 4, 5 of the casing 1 fixed to the surface of the vibration plate 37 is embedded in the vibration plate 37.

Said vibration plate 37 is designed slightly thicker than the converter; and being itself rigid enough, said plate serves to protect the casing 1 from directly contacting a rigid body.

Moreover the rigidity of said plate 37 spreads the load of a human body on said plate 37 and helps said plate 37 vibrate effectively.

The material of said plate 37 is not confined to a foamed product like foamed polyethylene; it can be anything that can well vibrate at low band; is light; is flexible enough to follow the contour of the cushion means 50; and is rigid enough to spread the load of a human body and prevent the casing 1 from directly contacting a rigid body. The cushion means 50 includes polyurethane foam covering the seat or a piece of cloth stretched on the frame of the seat; it can be anything that can behave without suppressing the vibration of said plate 37 as attached to the seat.

The human contact side of the vibration plate 37 is covered with an elastic material 51 such as urethane foam or sponge to eliminate discomfort of a human when he contacts the vibration plate 37. 52 denotes a connector by which the converter V is connected to a low-pass filter (not shown). On the back side of the vibration plate 37 nothing is attached for consideration of a cushion means 50 for the human seat means. Thus the casing 1 is exposed and accordingly a shield 53 is provided to protect the converter V. The shield 53 in this example is not always necessary. The human seat means includes: a cushion, a chair (not only one for home use but also one on a vehicle), a sofa and a bed.

In the present example the vibration plate 37 is provided on the cushion means 50 for human seat means, whereby the cushion means 50 prevents the vibration plate 37 from direct contact with a rigid surface like the floor.

When in this state an audio signal to drive the speaker is given via a low-pass filter to the coil 16, magnetic interaction happens between the magnetic force developed in the coil 16 and the magnetic force of the magnetic gap 12 and in consequence a body-felt vibration occurs through relative displacement between the yoke 8 supported by the damper 6 in the casing 1 and the casing 1. This vibration is transmitted through the casing 1 to the vibration plate 37. Thus the vibration plate 37 vibrates and this vibration is transmitted through an elastic means 51 to the human body. The vibration of the vibration plate 37 is synchronized with the audio signal to be heard by the ear; and, being based on a low-band audio signal, it is effective as a vibration for appreciation of double bass sound. By changing the material quality or thickness of the damper, a more desirable vibration effect can be obtained. The cut-off frequency of the low-pass filter, which depends on the sound source, is desirably about 150 Hz.

When a human sits on the vibration plate 37, the load is spread by the vibration plate 37 itself, whereby with the cushion means 50 preventing the converter from direct contact with the floor, the vibration plate 37 can vibrate in any condition without being suppressed.

When a human listens to music through a speaker, he is separated from the speaker and in this case provision of a delay circuit will be effective.

In the present example the yoke is held within the casing such that the casing and the yoke can displace from each other; an output is taken from the casing; the converter thus constituted is embedded in the vibration plate; and the vibration plate is set following the cushion means for human seat means. Thus a commercially available chair can be utilized for appreciation of double bass sound to a great economic advantage. Meanwhile, the whole assembly can be made thin and the user feels no discomfort. The application is not only for appreciation of music, but also for medicinal purpose, if the music to be reproduced is appropriately selected.

An example illustrated in FIGS. 14~21 is characterized in that a space formed at the intersection of the seat and the back of a chair when persons sit thereon is utilized to assemble a chair-vibrating mechanism, which makes it easy to appreciated double bass sound by using commercially available chair.

The constitution of the converter in this example is the same as in FIG. 2; therefore its description is omitted here.

37 denotes a flat vibration plate, which is made of a foamed product like foamed polyethylene with 15–20% foaming. It can vibrate well at low band; is light; and rigid enough to be inserted at the junction 62*c* of the seat 62*a* and the back 62*b* of a chair 62. Said plate 37 has a fitting hole 38 bored therein. The converter as loosely fitted into said hole 38 and with the flanges 4, 5 of the casing 1 fixed to a stepped part of said plate 37 is embedded in said plate 37. Said plate 37 is designed slightly thicker than the converter; and, being itself rigid enough, it serves to protect the casing 1 from direct contact with anything rigid.

The material of the vibration plate 37 is not confined to a foamed product like foamed polyethylene; it may be wood or Bakelite. The requirement is that it can vibrate well at low band; is light; and rigid enough to be inserted at the junction 62*c* of the chair 62.

A buffer means 63 is attached to one side of the vibration plate 37 to prevent a human from feeling as if a vibration happened locally as the result of his body coming into direct contact with the vibration plate 37 inserted at the junction 62*c* of the chair 62.

Thus when a human sits on the chair 62 and comes into contact with the vibration plate 37, he is in indirect contact through the buffer means 63 with the vibration plate 37 inserted at the junction 62*c* of the chair 62. 64 denotes a connector by which the converter V is connected to the amplifier 65 with a built-in low-pass filter. The present invention is applicable to either a chair with integrated back and seat or one with separated back and seat. Any chair will do, if only its back and seat are made of anything that can easily transmit vibration, such as urethane foam, sponge.

In the illustrated example, the device is located at the junction of seat and back; but as illustrated in FIGS. 19 and 20, it may be arranged such that the vibration plate 37 is set in a space formed between the human body 66, the back 62*b* and the seat 62*a* in the width direction of the back 62*b* and the seat 62*a* so that the vibration plate 37 comes at the intersection between the back 62*b* and the seat 62*a*. Meanwhile the converters V to be held in the vibration plate 37 can be as many as desired.

In this example the vibration plate 37 is a flat plate, but its shape is not confined to this. As illustrated in FIG. 21, it may be designed approximately prismatic so that it can fit a space formed between the back, the seat and the human body and thus the converter V can be held therein. The requirement is only that the device be of such a shape that it can be set at the junction of seat and back of chair to transmit vibration to the seat and the back. The vibration plate 37 in this example is attached with a buffer means 63, but this buffer means 63 will not be necessary when a human sitting on the chair 62 does not come into contact with the vibration plate 37. In this example the vibration plate 37 is inserted at the junction 62*c* of the chair 62.

When in this state an audio signal to drive the speaker is given to the coil 16 through an amplifier 65 with a built-in low-pass filter, a body-felt vibration is caused by relative displacement between the yoke 8 held by the damper 6 in the casing 1 and the casing 1 as the result of magnetic interaction between the magnetic force developed in the coil 16 and the magnetic force of the magnetic gap 12. This vibration is transmitted via the casing 1 to the vibration plate 37. Thereupon the vibration plate 37 vibrates and this vibration propagates to the seat 62*a* and the back 62*b* to vibrate the whole chair 62. Thus the vibration is transmitted to the body of a human sitting on the chair 62. The vibration of this vibration plate 37 is synchronized with the audio signal to be heard by the ear and it is based on a low-band audio signal. Thus it is effective as a vibration for appreciation of double bass sound. Moreover, a more desirable vibration effect can be produced when the material quality or thickness of the damper is properly selected. The cut-off frequency of the low-pass filter, which depends on the sound source, is desirably about 150 Hz. Since the vibration of the vibration plate 37 is prevented by the buffer means 63 from directly propagating to the human body, a human receives the vibration from the chair 62 as a whole.

In this example the vibration plate 37 is inserted at the junction 62*c* of the chair 62, but the vibration plate 37 can vibrate in any condition without being suppressed, because it is applied to a chair 62 having the back 62*b* and the seat 62*a* made not of a rigid material but of an elastic material and inserted between said back and seat.

Further a better effect will be obtained if a delay circuit is connected, because a human listening to music sits at a greater distance from the speaker than he is separated from the converter V.

In this example the converter is designed such that the yoke is set in the casing; the yoke can be displaced relative to the casing; and an output is taken from the casing. This converter is embedded in the vibration plate and this vibration plate can be located at the junction of seat and back of a commercially available chair for the purpose of appreciating double bass sound with a great economic advantage. Moreover, since the whole assembly can be made thin and applied to a chair at the intersection of seat and back, the user feels no discomfort. Thus the present invention is useful not only for musical appreciation but also for clinical treatment, if the music to be reproduced is properly selected.

An embodiment illustrated in FIGS. 22~26 is an improvement on the one in FIGS. 14~21. 37 denotes a flat vibration plate, which is made of a foamed product, for instance, foamed polyethylene with 15–20% foaming. It can vibrate well at low band; and is light and rigid. Said vibration plate 37 has a fitting hole 71 bored therein for assembling the electromechanical vibration converter. Said fitting hole 71 connects to a large-diameter hole 72; and between the holes 71 and 72 there is formed an annular stepped part 73. The converter as assembled in the fitting hole 71 and with the flanges 4, 5 of the casing 1 fixed to the stepped part 73 is embedded in the vibration plate 37.

The vibration plate 37 is so rigid that it can spread the load of a human body on the vibration plate 37, whereby said plate 37 can effectively vibrate. The material of the vibration plate 37 is not confined to a foamed product like foamed polyethylene; it can be anything that can vibrate well, is light and rigid enough to spread the load of a human body, thereby protecting the casing 1 from direct contact with anything rigid. In this example the casing 1 is attached to a stepped part 73 formed on the vibration plate 37, but it may be designed such that only a fitting hole 71 is provided and the flanges 4, 5 of the casing 1 are directly fitted to the surface of the vibration plate 37.

On the rear side of the vibration plate 37 there is provided a tongue 37*a* to be inserted at the intersection of seat and back of a chair; and using said tongue 37*a*, the vibration plate 37 can be stably fitted into the space formed at the seat-back intersection of the chair. At the front of the vibration plate 37 comes an elastic means 74 which removes discomfort of a human sitting in contact with the vibration plate 37. 75 denotes the input terminal of the converter. Said elastic means 74 may be omitted, when the vibration plate 37 is of such a material as causes no discomfort to a human body in contact therewith.

Said vibration plate 37 has a thin part 37*b* formed between two converters V, V; and at this thin part 37*b* the vibration plate 37 bends to follow the contour of a human body so that no discomfort may be caused to a human body contacting the vibration plate 37.

In this example the vibration plate 37 is located in the space at the intersection of seat and back of a chair. When an audio signal to drive the speaker is given through a low-pass filter to the coil 16, magnetic interaction occurs between the magnetic force developed in the coil 16 and the magnetic force of the magnetic gap 12 and in consequence a relative displacement takes place between the yoke 8 supported by the damper 6 in the casing 1 and the casing 1, causing a body-felt vibration. This vibration propagates through the casing 1 to the vibration plate 37. Thereupon the vibration plate 37 vibrates and this vibration propagates through an elastic means 74 to a human body. This vibration of the vibration plate 37 is synchronized with the audio signal to be heard by the ear and is based on a low-band audio signal. Accordingly it is effective as a vibration for appreciation of double bass sound. A more desirable vibration effect will be obtained by properly changing the material quality or thickness of the damper. The cut-off frequency of the low-pass filter, which depends on the sound source, is desirably about 150 Hz.

In this example the vibration plate 37 bends at its thin part 37*b* to follow the body contour of a user; therefore he can well sense the vibration of the vibration plate 37 without any discomfort.

In this case a tongue 37*a* is provided, but as indicated in FIG. 26, the vibration plate 37 may be designed as a flat plate with no tongue and may be laid on something of cushioning nature. In this case the vibration plate 37 is provided with a thin part 37*b* so that it can bend and follow the body contour; but said plate may be made of an appropriate material which permits the plate itself to follow the body contour.

Additional provision of a delay circuit will be effective, because a human listening to music sits off a speaker placed with a distance from the converter V.

In the converter of this example, the yoke is set in the casing such that the yoke and the casing can displace relative to each other; an output is taken from the casing; the converter is embedded in the vibration plate; and the vibration plate is covered with a buffer. Thus the structure is simplified and the vibration plate itself can spread the load falling on itself. Accordingly with the buffer made thin, the whole assembly can be reduced in thickness. Thus even when it is set on a chair or a sofa, it does not spoil the sitting comfort.

Since the vibration plate bends itself to follow the body contour, the user feels no discomfort and the vibration can effectively propagate to his body.

In an embodiment illustrated in FIGS. 24 and 26, the frame 2 is located on the side of the elastic means 74 and the converter V is fitted to the vibration plate 37; but the design may be such that the frame 3 is located on the side of the elastic means 74 and the converter V is fitted to the vibration plate 37.

In an embodiment illustrated in FIGS. 27~30, the converter has the same constitution as in FIG. 2, so its description is omitted, with identical symbols used. 37 denotes a flat vibration plate, which is made of a foamed product like foamed polyethylene with 15–20% of foaming. It can vibrate well at low band; and is light. Said plate 37 is set at the intersection of the seat 81*a* and the back 81*b* of a chair, with the end 37*a*′ of the opposite side 37*a* to the seat 81*a* in direct contact with the seat 81*a* and with the back side 37*c* in direct contact with the back 81*b* of the chair, so that the vibration directly propagates from the end 37*a*′ to the seat 81*a* and from the back side 37*c* to the back 81*b*. The vibration plate 37, as illustrated, can be designed increasingly thin toward the other end 37*b*, so that any angular part at the other end 37*b* of the vibration plate 37 may not touch a user's back, causing him discomfort.

This design of the thickness at the end 37*b* being less than at the end 37*a'* is not restrictive; the vibration plate 37 may be designed as a flat plate with uniform thickness.

In the vibration plate 37 there is provided close to the end 37*a'* opposed to the seat 81*a* and to the backside 37*c* opposed to the back 81*b* of the chair a fitting hole 82 opening toward the backside 37*c*; and the edge 2*a* of the casing 1 of the converter V is fitted to a stepped part 82*a* formed around said fitting hole 82. The converter V with one part thereof exposed toward the backside 37*c* of the vibration plate 37 for better efficiency of heat dissipation is embedded in the vibration plate 37. In this example, the case 3 is exposed toward the backside 37*c*, but it may be designed such that the side of the case 2 is exposed.

The material of the vibration plate 37 is not confined to a foamed product like foamed polyethylene; it may be a casing of wood or synthetic resin. The requirement is that it can vibrate well at low band and is light.

Further the vibration plate 37 is attached with a soft buffer 83 such as foamed polyurethane to improve the sitting comfort on its side in contact with the human body, i.e., on the front side 37*d* of it excepting the end 37*a'* opposed to the seat 81*a* and the backside 37*c* opposed to the back 81*b*. 84 denotes a cover to be aesthetically treated for appearance. 85 denotes a buffer to be attached to both sides of the vibration plate 37. When a human sits on a chair and contacts the vibration plate 37, he comes into indirect contact with the vibration plate 37 set on the chair through the buffer 83. 86 denotes a connector for connecting the converter V to an amplifier with a built-in low-pass filter. The seat and back may be integrated or separately provided. Any chair can be used, so long as the back 81*b* and the seat 81*a* are fabricated of a material such as urethane foam or sponge which can easily transmit vibration. Meanwhile, the number of converters V to be housed in the vibration plate 37 is arbitrary.

In this example the vibration plate 37 is set at the intersection of the seat 81*a* and the back 81*b* of a chair, with its end 37*a'* in direct contact with the seat 81*a* and its back side 37*c* in direct contact with the back 81*b*. When a user sits on the chair and comes into contact with the device according to the present invention, the end 37*a'* of the vibration plate 37 is strongly pressed against the seat 81*a*, while the backside 37*c* of the vibration plate 37 and the converter V are strongly pressed against the back 81*b* of the chair, resulting in a close fit between the two.

When in this condition an audio signal to drive the speaker is given to the coil 16 through an amplifier with a built-in low-pass filter, magnetic interaction happens between the magnetic force developed in the coil 16 and the magnetic force of the magnetic gap 12 and in consequence a relative displacement between the yoke 8 supported by the damper 6 in the casing 1 and the casing 1 causes a body-felt vibration. This vibration is transmitted to the vibration plate 37 through the casing 1. As the result the vibration plate 37 vibrates; this vibration propagates to the seat 81*a* and the back 81*b*; thereupon the whole chair vibrates and a human sitting on the chair receives this vibration and at the same time a direct vibration originating from the vibration plate 37.

Thereby since the converter V is fitted close to the end 37*a'* and the back side 37*c*, it goes without saying that the vibration propagates from the backside 37*c* of the vibration plate 37 to the back 81*b* of the chair; also the vibration is effectively transmitted from the end 37*a'* of the vibration plate 37 to the seat 81*a* of the chair, thereby causing the whole chair to vibrate. Therefore the difference in the intensity felt by a human between the vibration from the chair and the direct vibration from the vibration plate 37 is reduced and the human senses the vibration by his whole body, and not by a local part of the body. The vibration of the vibration plate 37 is synchronized with the audio signal to be heard by the ear and is based on a low-band audio signal; accordingly it is effective as a vibration for appreciation of double bass sound. A more desirable vibration effect can be obtained when the material quality or thickness of the damper is appropriately selected. The cut-off frequency of the low-pass filter, which depends on the sound source, is desirably about 150 Hz.

A human listening to music is separated from the speaker and there is a distance between the speaker and converter V; in this case provision of a delay circuit will be effective.

As described above in the converter of the present invention the yoke is set in a casing such that the casing and the yoke can be displaced relative to each other; an output is taken from the casing; this converter is embedded in a vibration plate; and the vibration plate can be located at the intersection of seat and back of a chair. Thus a commercially available chair can be applied economically for appreciation of double bass sound. Since the whole assembly can be made thin and can be attached to the chair utilizing the space at the intersection of seat and back of the chair, a user will not feel any discomfort. The present invention is not only available for musical appreciation, but also effective for treatment of psychiatric symptoms, if the music to be reproduced is properly selected.

In this converter, which is fitted close to the side of the vibration plate opposed to the chair seat with the seat side of the vibration plate and the backside of it in direct contact with the chair, the vibration of the vibration plate can be reliably transmitted to the chair without being damped, thereby causing the chair seat and back to vibrate reliably. Thus the difference in the intensity between the vibration felt from the front of the vibration plate and the vibration felt from the chair can be reduced and accordingly the vibration is felt not locally but by the whole body, resulting in good appreciation of double bass sound.

The converter illustrated in FIGS. 31~38 has the same constitution as the one in FIG. 6 and therefore its description is here omitted.

37 denotes a vibration plate of synthetic resin which can vibrate well and is light and rigid. Said plate 37 is made hollow by blow molding. It has a fitting hole 82 with a stepped part 82*a* to fit the converter V at a position close to the side opposed to the chair seat 81 and to the side opposed to the chair back. At said stepped part 82*a* the side 37*a*, i.e., the first vibration wall to transmit vibration to the seat 81 and the side 37*c*, i.e., the second vibration wall to transmit vibration to the back 81*b* are integrated. On both sides and about midpoint of the vibration plate 37 concave grooves 37*e* which narrow inward from the hollow walls run in the longitudinal direction. Said concave grooves 37*e* the ends which are in contact with the seat 81 of the chair, serve to make the side 37*a* of the vibration plate 37 bend and fit the user's body and at the same time to reinforce said plate against an external force different from said bending.

Said plate 37 is attached to the intersection of the seat 81*a* and the back 81*b* of the chair, with the end 37*a*' of the side 37*a* of said plate opposed to the chair seat 81 in direct contact with the seat 81*a* of the chair and the side 37*c* of it in direct contact with the back 81*b* of the chair; thus the vibration can propagate directly from the end 37*a*' to the seat 81*a*. When the vibration plate 37 is designed increasingly thin toward its end 37*b*, anything angular at the end 37*b* of said plate 37 can be prevented from contacting the user's body and accordingly the user feels no discomfort. In this case the end 37*b* is made less wide than the end 37*a*', but this design is not restrictive; said plate 37 may be designed as a flat plate with uniform width.

In said plate 37 there is provided a fitting hole 82 open toward the side 37*c* at a position close to the side 37*a*' of said plate 37 opposed to the chair seat 81 and to the side 37*c* of it opposed to the chair back 81*b*. The edge 2*a* of the casing 1 of the converter V is fitted to the stepped part 82*a* formed around said fitting hole 82; and the converter V with one part of it exposed to the side 37*c* of the vibration plate 117 for better efficiency of heat dissipation is embedded in the vibration plate 37. In this example the side of the case 3 is exposed to the side 37*c*, but it may be designed such that the side of the case 2 is exposed. The materials available for the vibration plate 37 include synthetic resins with relatively high rigidity such as polyethylene, acrylonitrile butadiene styrene resin (ABS resin), acrylonitrile styrene resin (AS resin), polyproprene (PB resin), polyphenylene oxide (PPO resin), vinylchloride resin; the requirement is that the material can vibrate well at low band and is light.

Further the vibration plate 37 is attached with a soft buffer 83 of such material as foamed polyethylene to improve the sitting comfort on the body contact side, i.e., the front side 37*d* of said plate 37 excepting the end 37*a*' opposed to the chair seat 81*a* and the side 37*c* opposed to the chair back 81*b*. 84 denotes a cover to be aesthetically treated for appearance. Thus when a human sits on the chair in contact with the vibration plate 37, he comes indirectly into contact with the vibration plate 37 set on the chair through said buffer 83. 86' denotes a hole into which a connector for connecting the converter V to an amplifier with a built-in low-pass filter is inserted. The seat and back may be integrated or provided as separate units. Any chair can be used, so long as its back 81*b* and the seat 81*a* are made of a material which can easily transmit vibration such as urethane foam, sponge. The number of converters V to be housed in the vibration plate 37 is arbitrary.

In this example, the vibration plate 37 is set at the intersection of the chair seat 81*a* and back 81*b*, with the end 37*a*' of said plate in direct contact with the seat 81*a* and the side 37*c* of it in direct contact with the back 81*b*. When the user sits on the chair and contacts the present device, the end 37*a*' of the vibration plate 37 is strongly pressed against the chair seat 81*a*, while the side 37*c* of the vibration plate 37 and the converter V are strongly pressed against the chair back 81*b*. Therefore, said end 37*a*' and said side 37*c* become in close contact with the seat and the back of the chair respectively.

When in this state an audio signal to drive the speaker is given to the coil 16 via the amplifier with a built-in low-pass filter, magnetic interaction happens between the magnetic force developed in the coil 16 and the magnetic force of the magnetic gap 12 and in consequence the yoke 8 held by the damper 6 in the casing 1 is displaced relative to the casing 1, thereby causing a body-felt vibration. This vibration is transmitted through the casing 1 to the vibration plate 37; thereupon the vibration plate 37 vibrates. This vibration then propagates to the chair seat 81*a* and back 81*b*, causing the whole chair to vibrate; and in consequence the user sitting on the chair feels a vibration direct from the vibration plate 37 as well as this vibration of the chair.

Thereby since the converter V is located close to the end 37*a*' and the side 37*c* of the vibration plate 37, of course the vibration propagates from the side 37*c* of said plate to the chair back 81*b* and the chair as a whole can vibrate with the vibration effectively transmitted from the end 37*a*' to the seat 81*a*. Thus with the difference in intensity reduced between the vibration originating from the chair and the vibration directly coming from the vibration plate 37, the user feels the vibration by the whole body, and not by any local part of the body. The vibration of the vibration plate 37 is synchronized with the audio signal to be heard by the ear and is based on a low-band audio signal; therefore it is effective as a vibration for appreciation of double bass sound. The vibration effect can be made more desirable by properly changing the material quality or thickness of the damper. The cut-off frequency of the low-pass filter, which depends on the sound source, is desirably about 150 Hz.

A human listening to music is separated from the speaker and there is a distance between him and the converter V; in this case a delay circuit will be effective.

The vibration plate 37 illustrated in FIGS. 35~38 is one formed by vacuum molding, its description is omitted, with like symbols given to like parts.

In this example, the vibration plate 37 is a plate of synthetic resin such as vinyl chloride resin, just like in the preceding example. It vibrates well at low band and it is light. Just like in the preceding example in this vibration plate 37, the fitting hole 82 with a stepped part 82*a* as a fitting means for the converter V, the side 37*a* which transmits vibration to the chair seat 81 and the side 37*c* which transmits vibration to the chair back 81*b* are integrated. On the surface of the vibration plate 37 a plurality of concave grooves 37*e* run in the longitudinal direction jutting over the chair seat 81. Said grooves are provided just like in the preceding example to make said plate bendable and at the same time to reinforce said plate against a vertical force.

The vibration plate 37 thus formed by vacuum molding, just like in the preceding example, is installed at the intersection of the chair seat 81*a* and back 81*b*, with the end 37*a*' of the side 37*a* opposed to the seat 81 in direct contact with the seat 81*a* and the side 37*c* in direct contact with the back 81*b*. Thus the vibration is directly transmitted from the end 37*a*' to the seat 81*a*. As illustrated, said plate 37 can be made increasingly thin toward the end 37*b* and thereby the contact of a user's body with anything angular at the end 37*b* of the vibration plate 37 can be avoided to prevent any discomfort to the user. Materials available for the vibration plate 37 include just like in the preceding example: polyethylene, acrylonitrile butadiene styrene resin (ABS resin), acrylonitrile styrene resin (AS resin), polypropylene (PB resin), polyphenylene oxide (PPO resin), vinyl chloride resin. Detailed description of the vibration plate 37 which is the same as in the preceding example is omitted.

In the present example the yoke is held in the casing such that the casing and the yoke can be displaced relative to each other; an output is taken from the casing; this converter is embedded in a vibration plate formed by blow molding or vacuum molding; and this vibration plate can be set at the intersection of the chair seat and back. Thus the present invention can be applied to a commercially available chair for appreciation of double bass sound to a great economic advantage. Moreover, the whole assembly can be made thin and it can be set at the intersection of chair seat and back without causing discomfort to the user. Not only for musical appreciation, the present invention will also be useful in treating a psychiatric case, when the music to be reproduced is rightly selected.

Since the converter is installed close to the chair seat side of the vibration plate, with the side of said plate opposed to the seat and the backside of said plate in direct contact with the chair, it does not happen that the vibration of the vibration plate transmitted to the chair seat and back is weakened. Namely the vibration of the vibration plate is reliably transmitted to the chair, thereby reliably causing the chair seat and back to vibrate. Thus with the difference in intensity reduced between the vibration from the front of the vibration plate and the vibration from the chair, the user can appreciate double bass sound well, because he feels the vibration not by any local part of the body but by the whole part of it.

The vibration plate according to this example is a blow-molded or vacuum-molded product of plastic material like synthetic resin. It can be mass-produced using an appropriate moldable material such as a relatively cheap plastic material like synthetic resin; therefore a cost-down of the audio equipment can be realized. Since the vibration plate produced by this method is designed as a hollow or solid plate, the vibration from the converter can be well synchronized with the thin wall of the vibration plate and the vibration of the vibration plate can well propagate to the whole chair, the user can better feel the vibration from the chair as well as from the vibration plate.

The converter illustrated in FIGS. 39 and 40 has the same constitution as the one in FIG. 2 and the relationship between said converter and the vibration plate is the same as that in FIG. 10; therefore a detailed description is omitted here. In this example the vibration plate 37 is made of a foamed product, for instance, foamed polyethylene of extent of foaming of 20~30. A speaker 91, as indicated in FIG. 31; is attached to the part of said plate 37 where the ears of a user come; and an audio signal to vibrate the ear drum is issued to the user from the speaker 91. The speaker 91 is direct-connected to the speaker terminal of audio equipment; the converter V is connected to an amplifier with a built-in low-pass filter; and the amplifier is connected to the speaker terminal of audio equipment.

The device is set on a cushion of the chair 92, whereby said cushion prevents the vibration plate 37 from directly contacting anything rigid such as the floor surface. The user rests on the vibration plate 37 with his ears held close to the speaker 91.

When in this state an audio signal to drive the speaker is given to the coil 16 through a low-pass filter, magnetic interaction happens between the magnetic force developed in the coil 16 and the magnetic force of the magnetic gap 12 and in consequence the yoke 8 held by the damper 6 in the casing displaces in relation to the casing 1, thereby causing a body-felt vibration. This vibration is transmitted to the vibration plate 37 through the casing 1. Thereupon the vibration plate 37 vibrates and this vibration propagates to the human body. Meanwhile, the audio signal from audio equipment goes into the speaker 91, which then issues an audible sound wave. The vibration of the vibration plate 37 is synchronized with the audible signal and is based on a low-band audio signal; therefore it is effective as a vibration for appreciation of double bass sound. Thus with the sound from the speaker 91 perceived as a vibration of the ear drum and the vibration of the vibration plate sensed by the body, the user can hear double bass sound and effectively enjoy music.

FIG. 40 illustrates the vibration plate 37 as applied to the auto and other seats. The vibration effect will become a more desirable one, when the material quality or thickness of the damper is appropriately selected. The cut-off frequency of the low-pass filter, which depends on the sound source, is desirably about 150 Hz.

When a user sits against the vibration plate 37, the load of his body is spread over the vibration plate 37 itself; thereby the cushion prevents the converter V from directly contacting the floor and in consequence the vibration plate 37 can vibrate in any state without being hindered.

In the present example too, the yoke is held in the casing such that the yoke and the casing can displace relative to each other; an output is taken from the casing; the converter is embedded in a vibration plate; and speakers are provided on the vibration plate; and this vibration plate is laid on a cushion of the human seat means. Therefore the user not only hears a sound at the ears, but also senses a mechanical vibration by the body. Thus the device can be set on a commercially available seating means to yield a minor space to create an effect of "presence" economically. Moreover, the whole thing can be made thin so that the user feels no discomfort. Furthermore, the present invention is not only useful for musical appreciation but also for clinical purpose, when a right music is selected for reproduction.

When applied on a vehicle, the device needs no separate speaker and this contributes to economy. Since the speaker is located close to the ear, bass sound does not attenuate even when reproduced at small volume and thus the user can enjoy music with full effect of bass.

FIGS. 41~43 illustrate an example of a cushion being employed. The constitution of the converter in this example is the same as in FIG. 2 and accordingly its description is omitted here.

37 denotes a flat vibration plate, which is made of a foamed product like foamed polyethylene with extent of foaming of 14~15. It vibrates well at low band; is light and rigid; and is bored with a fitting hole 101 for assembling the converter. Said fitting hole 101 connects to a large-diameter hole 102 and an annular stepped part 103 is formed between said holes 101 and 102. The converter as assembled in said fitting hole 101 and with the flanges 4, 5 of the casing 1 fitted to said stepped part 103 is embedded in a vibration plate 37. Said vibration plate 37 is made slightly thicker than the converter; and being itself rigid, it serves to prevent the casing 1 from directly contacting anything rigid.

Since the vibration plate 37 is made rigid, the load of a human body falling on the vibration plate 37 is spread over said plate 37 itself, whereby the vibration plate 37 can effectively vibrate. It is desirable that, when the vibration plate 37 is hard enough, a buffer hole 37' be provided to eliminate an audible sound generated by the vibration of the vibration plate 37. The material of the vibration plate 37 is not confined to a foamed product like foamed polyethylene; the requirement is that it can vibrate well at low band; be light and rigid enough to spread the load of a human body falling on it and prevent the casing 1 from directly contacting anything rigid.

Here the casing is attached to a stepped part 103 formed on the vibration plate 37, but it may be designed such that as illustrated in FIG. 42, only a fitting hole 101 is provided and the flanges 4, 5 of the casing 1 are directly attached to the surface of the vibration plate 37.

On one side of the vibration plate 37 is attached a buffer 104 which is springy such as urethane foam or rubber for preventing the vibration of said plate 37 from being suppressed on account of direct contact with the floor surface; and on the other side of it is attached an elastic means 105 to eliminate discomfort of a human body in contact with said plate 37. In this state the vibration plate 37 is assembled into the cushion 106. 107 denotes a connector for connecting the converter V to the low-pass filter (not shown). 108 denotes a ventilation hole.

In this example, when an audio signal to drive the speaker is given to the coil 16 through a low-pass filter, magnetic interaction happens between the magnetic force developed in the coil 16 and the magnetic force of the magnetic gap 12 and in consequence the yoke 8 held by the damper 6 in the casing 1 and the casing may be relatively displaceable, thereby causing a body-felt vibration. This vibration is transmitted through the casing 1 to the vibration plate 37. Thereupon the vibration plate 37 vibrates and thereby this vibration propagates to the human body via the elastic means 105 and the cushion 106. This vibration of the vibration plate 37 is synchronized with an audible signal and is based on a low-band audio signal; accordingly it is effective as a vibration for appreciation of double bass sound. The vibration effect will become a more desirable one, when the material quality or thickness of the damper is appropriately selected. The cut-off frequency of the low-pass filter, being dependent on the sound source, is desirably about 150 Hz.

In this example, when a human sits on the vibration plate 37, the load of his body is spread over the vibration plate 37 itself without causing the casing 1 to jut out above the vibration plate 37 and the buffer 104 prevents the vibration plate 37 from directly contacting the floor. Thus the vibration plate 37 can vibrate without hindrance in whatever condition.

A human listening to music is separated from the speaker and there is a distance between the speaker and the converter V. Therefore provision of a delay circuit will be effective.

In the converter of this example the yoke is held in the casing such that the yoke and the casing can displace relative to each other; an output is taken from the casing; the converter is embedded in a vibration plate; and this vibration plate is covered with a buffer. Thus not only the structure is simplified, but also the vibration plate itself can spread the load falling thereon; and accordingly the whole thing can be made thin. Thinness of the whole thing implies that the setting comfort is not affected by a chair or a sofa placed thereon.

An example illustrated in FIGS. 44 and 45 is characterized in that a headphone is employed to listen to music and the sound is reproduced by an audio signal as a mechanical vibration to be sensed bodily.

The relation between the converter and the vibration plate in this example is the same as illustrated in the above examples; therefore its description is omitted.

FIG. 44 is a block diagram of the electric circuit according to the present invention. FIG. 45 illustrates a specific embodiment of the electric circuit in FIG. 44.

110, 110' represent the amplifiers for respective channels in a stereophonic audio equipment. Circuit breakers 111, 111' are connected to the speaker terminals 110*a*, 110'*a* of respective amplifiers 110, 110'. Said circuit breakers 111, 111' serve to break the circuit when the converter V is impressed with an excessive input.

112, 112' represent low-pass filters, whose outputs are respectively connected to the converters V,V.

113, 113' represent attenuators inserted between the headphone 114 and the speaker terminals 110*a*, 110'*a* for the purpose of regulating the sound volume of the two channels in the headphone 114.

In this example, when an audio signal to drive the speaker is given to the coil 16 through the low-pass filters 112, 112', on account of magnetic interaction between the magnetic force developed in the coil 16 and the magnetic force of the magnetic gap 12 the yoke 8 held by the damper 6 in the casing 1 and the case displaces relative to the casing 1 and as the result a body-felt vibration occurs. This vibration is transmitted through the casing to the vibration plate. The vibration plate vibrates and this vibration propagates to the human body.

The vibration of the vibration plate is synchronized with an audible signal and is based on a low-band audio signal which has passed through the filters 112, 112'; therefore it is effective as a vibration for appreciation of double bass sound. The vibration effect will be improved, if the material quality or thickness of the damper is appropriately selected. The cut-off frequency of the low-pass filters 112, 112', depending on the sound source, is desirably 150 Hz or so. In this example the low-pass filters 112, 112' are employed, but they are not always necessary.

In the use of the audio equipment according to the present invention, at first the variable resistances 115, 115' are operated to regulate the current level in the coil 16 and thereby set the vibration developed in the converters V, V at optimum point. Thereby the signal sent to the converters V, V is rectified by the diodes $D_1$, $D_2$, smoothed by the condensers $C_1$, $C_2$; and then it goes to the light-emitting diodes $L_1$, $L_2$. The level of the current supplied to the converters V, V is indicated by the light-emitting diodes $L_1$, $L_2$.

Next, by operating the variable resistances 116, 116' of the attenuators 113, 113', the output level to the headphone jack 117 is adjustably set to optimize the sound volume of the headphone 114.

Thus an audible sound is reproduced from the headphone 114, while a body-felt vibration is generated from the converters V, V, thereby enabling musical enjoyment with full effect of volume.

In this way the present invention, which can enable to enjoy music through that a body-felt vibration is produced in addition to a reproduced sound at the headphone, can eliminate the drawback of a headphone which lacks in a dynamic effect.

What is claimed is:

1. Audio-band electromechanical vibration converter comprising:

a flat hollow casing comprising upper and lower frames;

a flat damper means which is held within said casing, its outer edge being attached to said casing and its middle portion being freely moveable in said casing;

a yoke attached to the inner edge of said damper means which extends outside of the yoke, said yoke being held by said damper means within said casing such that said yoke can displace relative to said casing, said yoke having a magnetic pole and a magnetic gap which is formed on a plane containing said damper means; and a coil installed in said magnetic gap of said yoke, said coil being set on said plane; whereby a mechanical vibration is produced within said casing through relative displacement between said casing and said yoke, which results from magnetic interaction between the magnetic force developed in said coil and the magnetic force of said magnetic gap.

2. The audio-band electromechanical vibration converter claimed in claim 1, wherein portions at which the converter is to be fitted to a vibration plate are provided on the outer side periphery of the casing.

3. Converter of claim 1, wherein two damper means are provided, one of them being installed within a plane containing said magnetic gap and the other being installed out of said plane, whereby the yoke can be displaced in said casing by said two damping means.

4. Converter of claim 1, wherein a coil frame is attached to the casing; a coil is wound on said coil frame; and said coil is set in the magnetic gap.

5. Audio vibration equipment comprising:

a flat hollow casing;

a flat damper means which is held within said casing, with its outer edge attached to said casing and its middle portion freely moveable in said casing;

a yoke attached to the inner edge of said damper means which extends outside of the yoke, said yoke being held within the casing by said damper means such that said yoke can displace relative to said casing, said yoke having a magnetic pole and a magnetic gap which is formed on a plane containing said damper means;

a coil set in said magnetic gap, said coil being set on said plane; and a vibration plate with said casing embedded therein, said casing connected to the vibration plate at a periphery of the casing, whereby a mechanical vibration which results from magnetic interaction between the magnetic force developed in said coil and the magnetic force of said magnetic gap is produced within said casing through relative displacement between said casing and said yoke, and transmitted to said vibration plate.

6. Equipment of claim 5, wherein said vibration plate vibrates well, is light and rigid, and can be set at the intersection between the seat and back of a chair.

7. Equipment of claim 5, wherein said vibration plate is designed bendable and provided with a tongue to be inserted into the intersection between the seat and back of a chair, so that said vibration plate can be set in a space formed at the intersection between the seat and back of a chair.

8. Equipment of claim 5, wherein said vibration plate vibrates well, is light and rigid and can be applied following the contour of a chair cushion and is additionally provided with a speaker.

9. Equipment of claim 5, wherein said vibration plate is designed to vibrate well, be light and rigid and it is provided on one side with an elastic means to eliminate discomfort due to contact with the vibration plate and on the other side with a vibration-suppressing buffer, thereby enabling the use of the equipment as a cushion.

10. Equipment of claim 1, wherein said vibration plate vibrates well, is made light and rigid; said vibration plate itself can spread and bear the load falling thereon.

11. Equipment of claim 5, wherein said vibration plate vibrates well, is made light and rigid; can be applied following the contour of a cushion of seat means for humans; and has an additional elastic means provided on one side thereof to eliminate discomfort of contact with the vibration plate.

12. Equipment of claim 5, wherein said vibration plate vibrates well and is light and rigid and within the vibration plate the casing is installed close to the side of the vibration plate opposed to the chair seat in contact with the chair seat and the side of the vibration plate opposed to the chair back in contact with the chair back so that the side of the vibration plate opposed to the seat and the side of the vibration plate opposed to the back may be in contact with the seat and back respectively.

13. Equipment of claim 12, wherein said vibration plate is a vacuum-molded product.

14. Equipment of claim 12, wherein said vibration plate is a blow-molded product.

15. Equipment of claim 12, wherein said vibration plate is a solid plate.

16. The equipment of claim 5 wherein the vibration plate has an opening for receiving the casing within the opening with surfaces of the casing spaced inward from adjacent surfaces of the plate.

17. The equipment of claim 16 further comprising a relatively large hole in continuation of the opening adjacent a surface of the vibration plate, the plate having a step parallel to a surface of the plate between the opening and the relatively large hole, the step being configured for receiving a flange connected to the casing.

18. The equipment of claim 17 wherein the vibration plate is hollow having first and second opposite sides joined at edges of the plate and at the step.

19. The equipment of claim 17 wherein the casing is constructed of two frames joined at flanges and wherein the flanges are mounted on the step.

20. The equipment of claim 17 wherein the vibration plate is made of foamed material having voids content of from about 15 to 30% by volume.

21. The equipment of claim 17 wherein the vibration plate is made of a material selected from the group of resins consisting of polyethylene, acrylonitrile butadiene styrene, acrylonitrile styrene resin, polyproprene, polyphenylene oxide and vinylchloride.

22. The equipment of claim 17 further comprising buffer holes in the vibration plate spaced from the opening for preventing audible sound from eminating from the vibration plate.

23. The equipment of claim 17 wherein the plate has parallel opposite flat surfaces and wherein the opening and relatively large hole extend inward from the opposite surfaces.

24. The equipment of claim 17 wherein the plate has plural openings and relatively large holes and has a portion of reduced thickness between adjacent openings and holes.

* * * * *